US010329938B2

(12) United States Patent
Prenger et al.

(10) Patent No.: US 10,329,938 B2
(45) Date of Patent: Jun. 25, 2019

(54) ASPIRATING FACE SEAL STARTER TOOTH ABRADABLE POCKET

(71) Applicant: General Electric Company, Schenectady, NY (US)

(72) Inventors: Brian Joseph Prenger, Mason, OH (US); John David Bibler, Kings Mills, OH (US); Mark Leonard Hopper, West Chester, OH (US)

(73) Assignee: General Electric Company, Schenectady, NY (US)

( * ) Notice: Subject to any disclaimer, the term of this patent is extended or adjusted under 35 U.S.C. 154(b) by 195 days.

(21) Appl. No.: 15/609,464

(22) Filed: May 31, 2017

(65) Prior Publication Data

US 2018/0347389 A1 Dec. 6, 2018

(51) Int. Cl.

| | |
|---|---|
| ***F01D 11/00*** | (2006.01) |
| ***F01D 11/12*** | (2006.01) |
| ***F01D 11/02*** | (2006.01) |
| ***F04D 29/08*** | (2006.01) |
| *F01D 9/04* | (2006.01) |
| *F01D 5/02* | (2006.01) |

(52) U.S. Cl.

CPC ..... *F01D 11/122* (2013.01); *F01D 11/02* (2013.01); *F04D 29/083* (2013.01); *F01D 5/02* (2013.01); *F01D 9/041* (2013.01); *F05D 2220/31* (2013.01)

(58) Field of Classification Search

CPC ..... F01D 11/02; F01D 11/122

See application file for complete search history.

(56) References Cited

U.S. PATENT DOCUMENTS 3,383,033 A * 5/1968 Moore ..... F01D 11/001 415/111
3,547,455 A * 12/1970 Daunt ..... F01D 11/02 277/415
5,975,537 A 11/1999 Turnquist et al.
6,676,369 B2 1/2004 Brauer et al.

(Continued)

OTHER PUBLICATIONS

U.S. Appl. No. 15/450,130, filed Mar. 6, 2017, Prenger et al.
PCT/US17/030210, dated Apr. 28, 2017, Gibson et al.
PCT/US17/027096, dated Apr. 12, 2017, Gibson et al.

*Primary Examiner* — Hieu T Vo
*Assistant Examiner* — Sherman D Manley
(74) *Attorney, Agent, or Firm* — Dority & Manning, P.A.

(57) ABSTRACT

Aspirating face seal between high and low pressure regions of turbomachine between rotatable and non-rotatable members of turbomachine includes gas bearing rotatable and non-rotatable face surfaces, starter tooth mounted on the rotatable member operable to sealingly engage abradable starter seal land on the non-rotatable member, and annular pocket in an abradable coating or other abradable material of starter seal land. Abradable material may be in radially inwardly facing groove extending into non-rotatable member. Pocket may extend radially outwardly from a cylindrical radially outer abradable surface to pocket bottom which includes thin abradable material layer groove surface along the non-rotatable member. Pocket may extend axially aftwardly from annular forward groove side surface into abradable coating. Pocket may be bounded axially by abradable material. Pocket may be tapered having taper decreasing axially aftwardly away from annular forward groove side surface.

32 Claims, 17 Drawing Sheets

(56) References Cited

U.S. PATENT DOCUMENTS 6,708,482 B2 3/2004 Seda
6,758,477 B2 * 7/2004 Brauer ..... F01D 11/02 277/379
7,044,470 B2 5/2006 Zheng
7,371,044 B2 * 5/2008 Nereim ..... F01D 5/3015 415/173.7
8,109,716 B2 2/2012 Glahn et al.
8,109,717 B2 2/2012 Glahn et al.
8,167,545 B2 * 5/2012 Glahn ..... F01D 11/001 415/171.1
8,272,643 B2 * 9/2012 Garrison ..... F01D 11/001 277/348
8,387,991 B2 * 3/2013 Durling ..... F16J 15/444 277/412
8,740,224 B2 6/2014 Zheng et al.
9,567,908 B2 * 2/2017 Bordne ..... F02C 7/06
2004/0213666 A1 * 10/2004 Gieg ..... F01D 11/127 415/170.1
2005/0150234 A1 * 7/2005 Urso ..... F01D 11/001 60/796
2007/0098545 A1 * 5/2007 Alvanos ..... F01D 5/081 415/170.1
2007/0253809 A1 * 11/2007 Glynn ..... F01D 11/04 415/174.2
2008/0018054 A1 * 1/2008 Herron ..... F01D 11/02 277/409
2009/0142182 A1 * 6/2009 Kapustka ..... F01D 25/162 415/142
2009/0238683 A1 * 9/2009 Alvanos ..... F01D 11/001 415/173.7
2011/0229311 A1 * 9/2011 Varanasi ..... F01D 11/005 415/170.1
2011/0262277 A1 * 10/2011 Sjoqvist ..... F01D 9/041 416/213 R
2012/0027575 A1 * 2/2012 Manzoori ..... F01D 11/02 415/174.5
2012/0251290 A1 * 10/2012 Turnquist ..... F01D 11/001 415/1
2015/0330244 A1 * 11/2015 Vo ..... F01D 9/065 415/173.5
2018/0252317 A1 * 9/2018 Prenger ..... F16J 15/447

* cited by examiner

ASPIRATING FACE SEAL STARTER TOOTH ABRADABLE POCKET

BACKGROUND OF THE INVENTION

The present invention relates generally to aspirating face seals between rotor and stator assemblies and, more particularly, to an abradable seal land for an aspirating face seal starter tooth.

Aspirating face seals minimize leakage of a fluid, such as compressed air or combustion gases, by restricting flow between an area of high pressure and an area of low pressure. Aspirating face seals (AFS) control leakage by compensating for variations in the gap which may exist between a rotor and stator. Such seals have been disclosed for use in rotating machinery, including but not limited to, gas turbine engines used for power generation and for aircraft and marine propulsion.

Fluid leakage through gas turbine engine seal assemblies may significantly increase fuel consumption and adversely affect engine efficiency. Additionally, fluid leakage may cause damage to other components and/or increase overall engine maintenance costs. Because of the location of the seal assemblies and/or the operating environment, some known seal assemblies may deteriorate over time.

Some embodiments of aspirating face seals are configured as oppositely facing rotatable first and non-rotatable second seal elements. The rotatable first seal element is attached to, or is a monolithic portion of, the rotor. Likewise, such seals typically have the stator supporting the non-rotatable second seal element which is attached to, or a monolithic portion of, a slider. Retraction springs, typically coil springs, are used to separate or retract the non-rotating second seal element from the rotating first seal element during low or no power conditions. The non-rotatable second seal element is mounted on the slider supported by the stator. Examples of such aspirating face seals are disclosed in patent applications from General Electric Company in Ser. Nos. 2016/41013072 and 2016/41016504, filed in INDIA, assigned to the present Assignee, the General Electric Company, and incorporated by reference. Ser. No. 2016/41013072 is entitled "ANTI-CONING ASPIRATING FACE SEAL" and was filed in India on Apr. 14, 2016. Ser. No. 2016/41016504 is entitled "ASPIRATING FACE SEAL TOOTH CONFIGURATION" and was filed in India on May 11, 2016.

U.S. Pat. No. 6,676,369 to Brauer, et al., issued Jan. 13, 2004, and entitled "Aspirating Face Seal with Axially Extending Seal Teeth", discloses a gas turbine engine aspirating face seal including a rotatable engine member and a non-rotatable engine member and a leakage path therebetween. Annular generally planar rotatable and non-rotatable gas bearing face surfaces circumscribed about a centerline are operably associated to the rotatable and non-rotatable engine members respectively. Radially inner and outer tooth rings axially extend away from a first one of the rotatable and non-rotatable gas bearing face surfaces across the leakage path and towards a second one of the gas bearing face surfaces. An auxiliary seal includes an annular restrictor tooth extending radially across the leakage path from a second one of the rotatable and non-rotatable gas bearing face surfaces towards the first one of the rotatable and non-rotatable gas bearing face surfaces. Coiled springs are utilized to separate the gas bearing face surfaces.

Known seal designs include a starter tooth mounted on a rotatable engine member. The starter tooth is an annular labyrinth seal tooth designed and operable to sealingly engage a corresponding abradable starter seal land. The starter seal abradable land is typically an abradable coating on an interior surface of an annular slider axially slidingly mounted on the annular non-rotatable engine member.

It is also important to note that aspirating face seal technology uses phrases such as "air bearing", "air dam", and "air flow", wherein it is understood that the word "air" is used to describe the working fluid of the seal. The working fluid of an aspirating face seal can include, without limitation, compressed air, combustion gases, and/or steam. Note that an aspirating face seal is a non-contacting seal in that the first and second parts or rotatable and non-rotatable seal elements of the seal are not intended to touch, but may for short periods of time, during which they experience what are known as rubs.

One potential cause of air bearing contact is an aggressive rub between the rotor starter tooth and the slider abradable land or coating. As the tooth wears into the coating, heat generated by the rub causes the slider air bearing surface to distort. In addition, the starter tooth rub forces prevent or inhibit the slider from retracting. These two effects lead to air bearing contact. Heat generated by the contact creates a large thermal gradient across the slider air bearing face, which can cause the surface to crack. To prevent this problem, starter tooth rubs must be minimized or eliminated when the seal is closed.

BRIEF DESCRIPTION OF THE INVENTION

A turbomachine aspirating face seal assembly includes an aspirating face seal circumscribed about a centerline axis and operable for restricting leakage of high pressure air flow from a relatively high pressure region of the turbomachine to a relatively low pressure region of the engine at a juncture between a non-rotatable member of the turbomachine and a rotatable member of the turbomachine. The rotatable and non-rotatable members include gas bearing rotatable and non-rotatable face surfaces respectively. A starter seal tooth mounted on the rotatable member is designed and operable to sealingly engage a corresponding abradable starter seal land on the non-rotatable member and an annular pocket is in an abradable coating or other abradable material of the abradable starter seal land.

The starter tooth may be an annular labyrinth seal tooth. The assembly further includes a primary seal tooth, and the starter and primary seal teeth are annular labyrinth seal teeth designed and operable to sealingly engage corresponding abradable starter and primary seal lands respectively on the non-rotatable member.

The abradable coating or the abradable material may be disposed in a radially inwardly facing groove extending radially outwardly into the non-rotatable member. The inwardly facing groove includes a radially inwardly facing cylindrical groove surface along the non-rotatable member, and the radially inwardly facing groove includes annular forward and aft groove side surfaces extending radially inwardly from the groove surface and axially bounding the abradable coating or the starter seal land. The annular pocket may extend radially outwardly from a cylindrical radially outer abradable surface of the starter seal land or the abradable coating to a pocket bottom and the pocket bottom includes a thin abradable material layer of the abradable material of the starter seal land or the abradable coating surrounding the radially inwardly facing cylindrical groove surface along the non-rotatable member. The annular pocket may extend axially aftwardly from the annular forward groove side surface into the abradable coating or the starter seal land.

The annular pocket may extend radially outwardly from a cylindrical radially outer abradable surface of the starter seal land or the abradable coating to a pocket bottom, and the pocket bottom may include a portion of the radially inwardly facing cylindrical groove surface.

The annular pocket may extend radially outwardly from a cylindrical radially outer abradable surface of the starter seal land or the abradable coating to a pocket bottom and be bounded axially by the abradable material of the abradable coating or the starter seal land. The assembly may further include a pocket width between axially spaced apart annular forward and aft sides of the pocket, a tip width of a radially outer tip of the starter tooth, and the pocket width greater than the tip width.

The annular pocket may be tapered and have a taper decreasing axially aftwardly away from the annular forward groove side surface and a thickness of the coating in the annular pocket increasing axially aftwardly away from the annular forward groove side surface. The tapered annular pocket may extend axially aftwardly from the annular forward groove side surface into the starter seal land or the abradable coating.

The assembly may further include an annular slider axially slidingly mounted on the non-rotatable member, the starter seal land and the non-rotatable face surface mounted on the slider, a retracting means for retracting the annular slider away from the rotatable member and the non-rotatable face surface away from the rotatable surface, and a primary tooth. The starter and primary teeth may be annular labyrinth seal teeth designed and operable to sealingly engage corresponding abradable starter and primary seal lands. The primary tooth may be on the rotatable member and the primary seal land on the slider or the primary tooth may be on the annular slider and the primary seal land on the rotatable member. The retracting means may include a plurality of circumferentially spaced apart springs, and each of the springs may be axially disposed between the slider and the non-rotatable member.

The starter tooth may be mounted on a seal teeth carrier on the rotatable member.

DETAILED DESCRIPTION OF THE INVENTION

Figure 1:
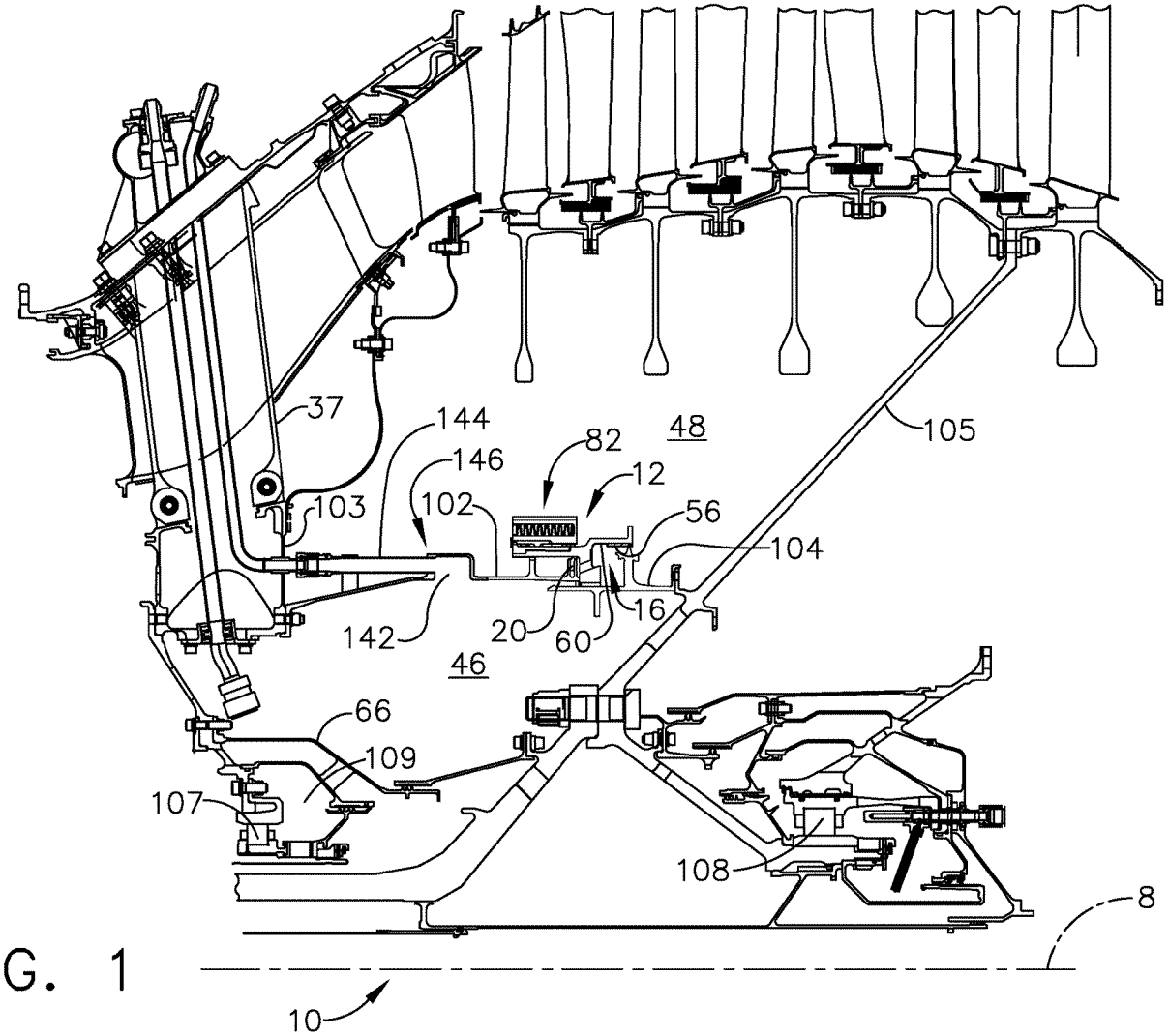
FIG. 1 is a cross-sectional view illustration of a portion of an exemplary gas turbine engine with a first exemplary embodiment of an aspirating face seal having a starter tooth land abradable coating with a pocket.
Figure 2:
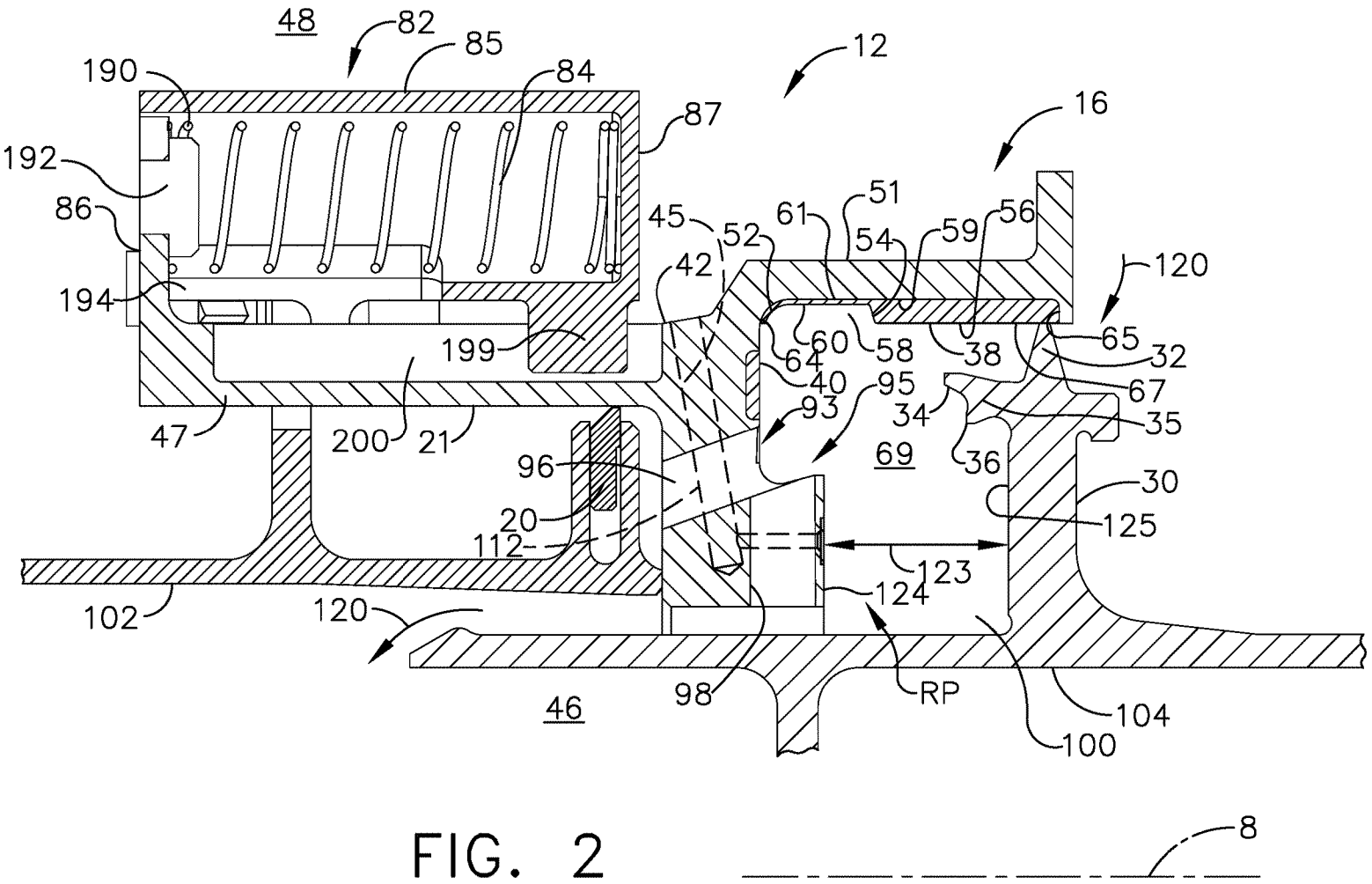
FIG. 2 is an enlarged cross-sectional view illustration of the aspirating gas bearing face seal illustrated in FIG. 1 in an opened engine off position.
Figure 3:
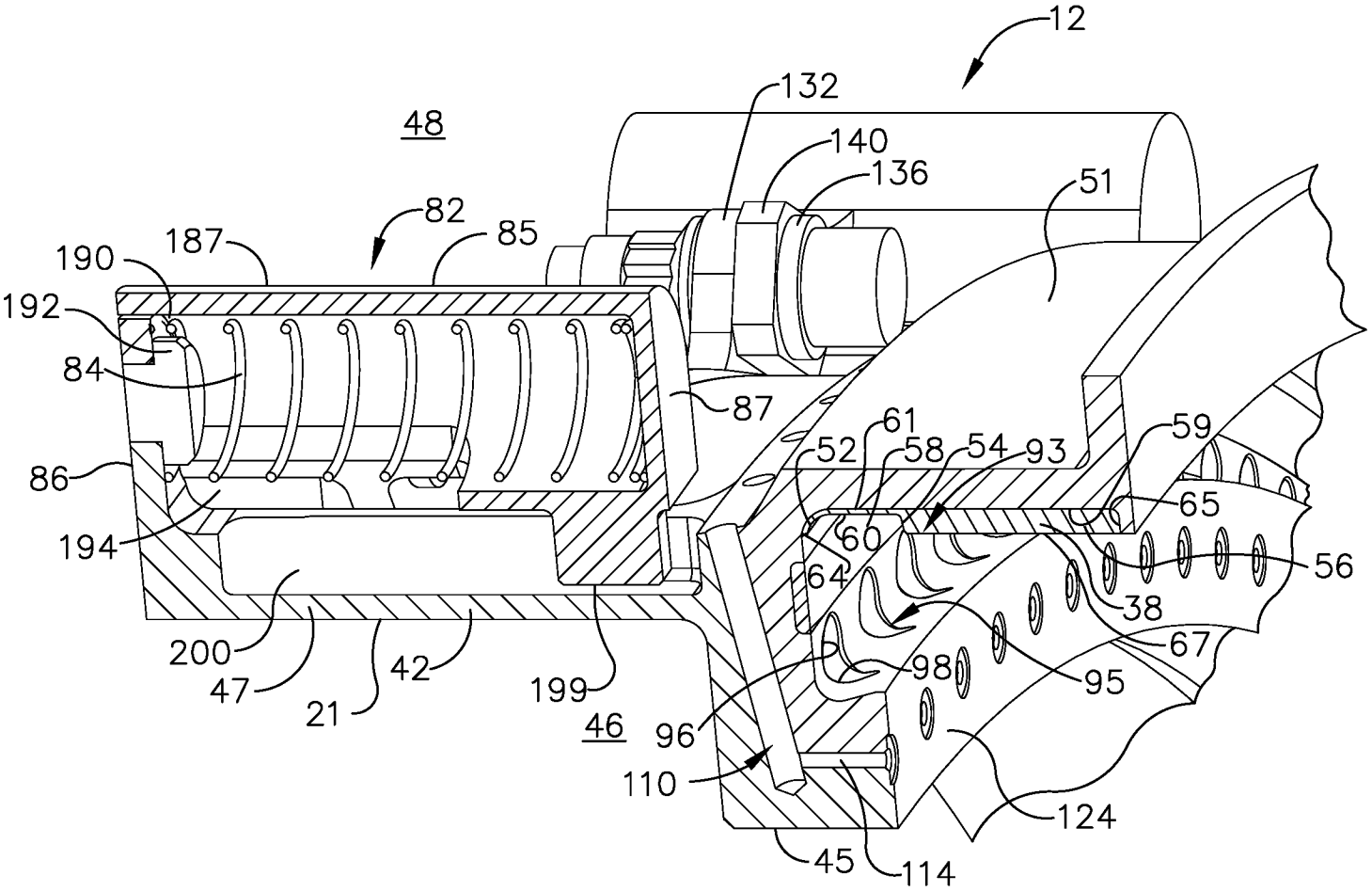
FIG. 3 is a cut-away perspective view illustration of a stator portion of the aspirating gas bearing face seal illustrated in FIG. 2.

Illustrated in FIGS. 1-3 is a first exemplary embodiment of an aspirating face seal assembly 12 having an annular aspirating face seal (AFS) 16 and a secondary seal 18 which is illustrated herein as including a piston ring 20 as illustrated in FIG. 2. The face seal assembly 12 is designed for controlling leakage or sealing between a high pressure region 48 and a low pressure region 46 such as may be found in a turbomachine such as a gas turbine engine 10 as illustrated in FIG. 1. Turbomachines include, but are not limited to, steam turbines, compressors, and turbocompressors such as may be used in the gas and oil industry, or similar apparatus.

Referring to FIG. 1, the exemplary embodiment of the turbomachine or gas turbine engine 10 is circumscribed about a centerline axis 8 of the engine 10 and includes an annular stationary stator or non-rotatable member 102 coupled to an annular frame 103 and a rotating or rotatable member 104 coupled to a rotor 105, at least in part, rotatably supported by an aft bearing 108. The frame 103 is illustrated herein as an annular turbine center frame 37 circumscribed about the centerline axis 8 of the engine 10. Additionally, the non-rotatable member 102 is a stationary annular member circumscribed about the centerline axis 8 of the gas turbine engine 10. In the embodiments illustrated herein, the non-rotatable member 102 is bolted to the frame 103 and the rotatable member 104 is rotatably coupled within the engine 10 to rotate about the centerline axis 8. The high pressure region 48 is located radially outwardly of the low pressure region 46, and the non-rotatable member 102 is located radially between the high and low pressure regions 48, 46. The frame 103 supports a middle bearing 107 in an annular sump 109 bounded by a generally conical sump member 66 located radially inwardly of the non-rotatable member 102.

A drain hole 142 in the non-rotatable member 102 is located upstream or forward of the aspirating face seal 16 and the secondary seal 18. A drain tube 144 is connected to and in fluid communication with drain hole 142. The drain tube 144 and the drain hole 142 provides a drain assembly 146 to help prevent oil from flowing into the aspirating face seal 16.

Figure 4:
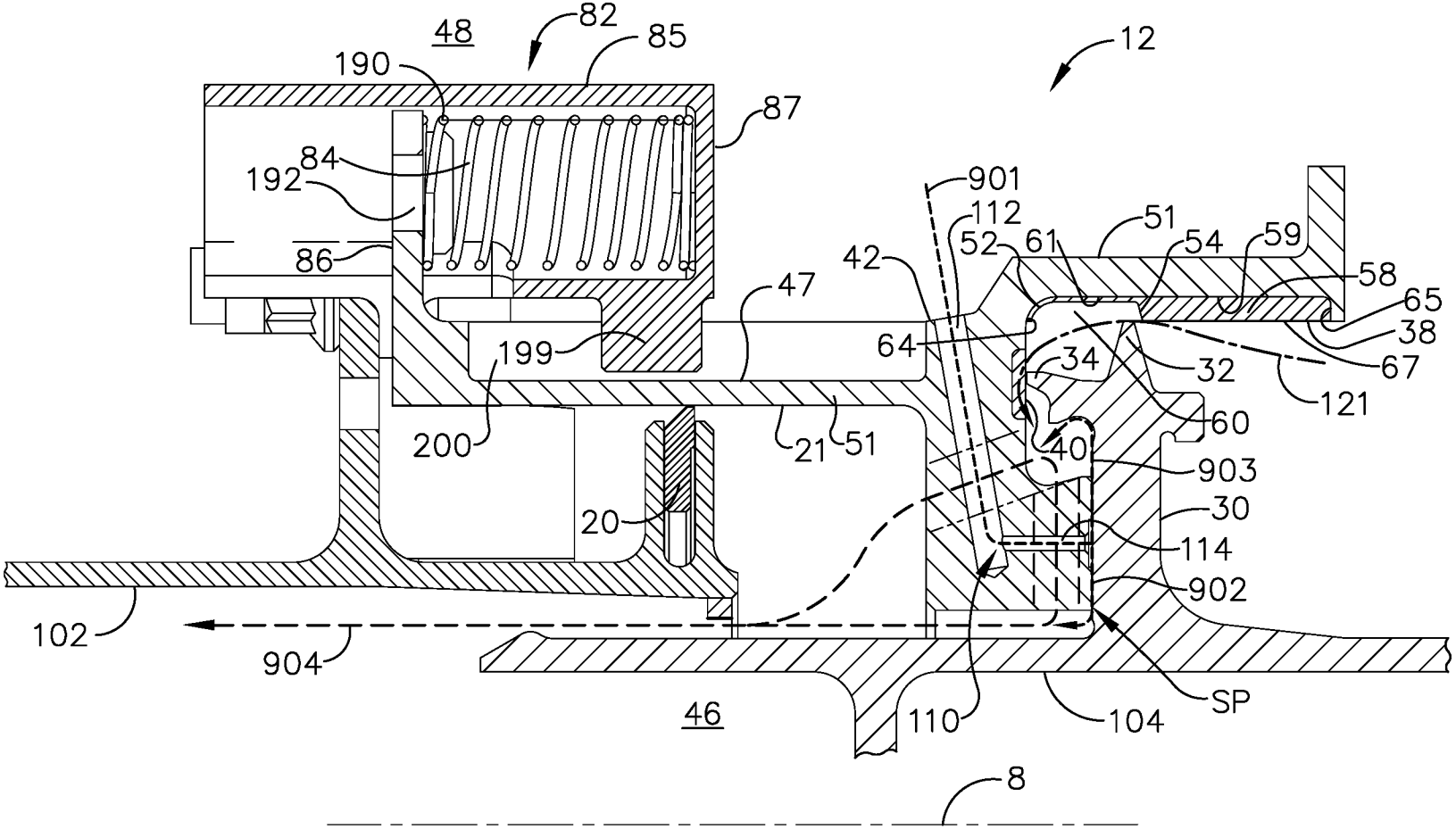
FIG. 4 is a cross-sectional view illustration of the aspirating gas bearing face seal illustrated in FIG. 2 with feed holes extending radially inwardly through an aft ring of the stator of the aspirating gas bearing face seal in a closed position.
Figure 5:
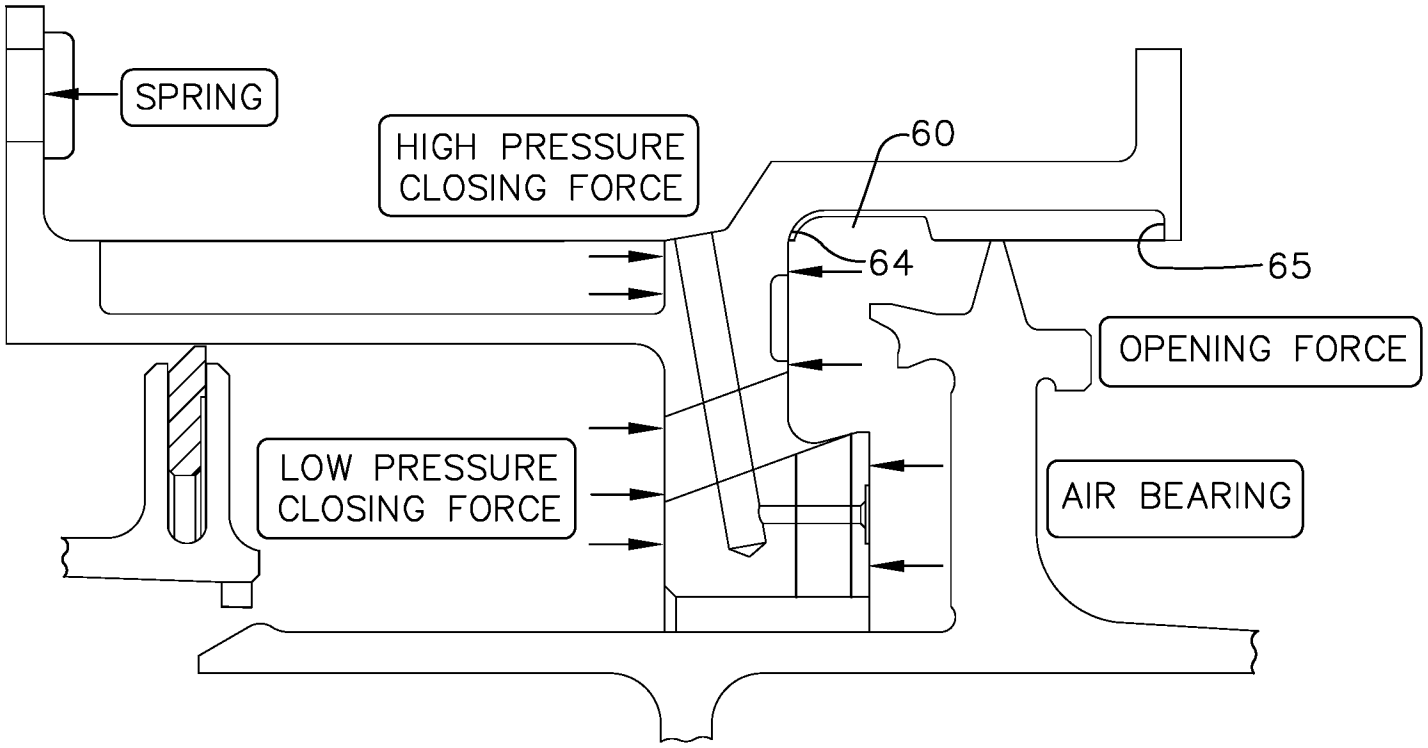
FIG. 5 is a diagrammatical illustration of forces acting on the aspirating gas bearing face seal illustrated in FIG. 4.

Referring to FIGS. 1, 4, and 5, the aspirating face seal 16 is used to restrict leakage of high pressure air flow 120 from the relatively high pressure region 48 to a relatively low pressure region 46 between the non-rotatable member 102 and the rotatable member 104. The high pressure AFS air flow 120 passes through the aspirating face seal 16 between the rotatable and non-rotatable members 104, 102 and between gas bearing rotatable and non-rotatable face surfaces 125, 124 respectively. The rotatable and non-rotatable face surfaces 125, 124 are circumscribed around and generally perpendicular to the engine centerline axis 8. An air bearing film is formed between the rotatable and non-rotatable face surfaces 125, 124 which function as a slider bearing face and a rotor bearing face, respectively.

The embodiment of the aspirating face seal 16 illustrated in FIGS. 4 and 5 includes a rotatable seal teeth carrier 30 which may be an annular flange on the rotatable member 104. The rotatable face surface 125 is on the carrier 30. Primary, starter, and deflector teeth 34, 32, 36 are mounted radially outwardly of the rotatable face surface 125 on the seal teeth carrier 30. The primary and starter teeth 34, 32 are annular labyrinth seal teeth designed and operable to sealingly engage corresponding annular abradable primary and starter seal lands 40, 38 located and mounted on an annular slider 42 axially slidingly mounted on the annular non-rotatable member 102 illustrated in FIGS. 2 and 3. The annular slider 42 includes a central ring 45 and annular forward and aft extensions 47, 51 extending forwardly and aftwardly, respectively, from the central ring 45.

The primary tooth 34 extends axially forward and slightly radially outwardly from a forward carrier extension 35 of the seal teeth carrier 30. The starter seal land 38 faces radially inwardly from and is carried on the annular aft extension 51 of the annular slider 42. The exemplary annular starter seal land 38 disclosed herein includes an abradable coating 56 disposed in an annular inwardly facing groove 58 extending radially outwardly into the annular aft extension 51. The annular inwardly facing groove 58 includes an axial portion 61 of a radially inwardly facing cylindrical groove surface 59 along the annular aft extension 51 of the slider 42 of the non-rotatable member 102. The annular inwardly facing groove 58 includes annular forward and aft groove side surfaces 64, 65 extend radially inwardly from the groove surface 59 and axially bound the abradable coating 56 or the starter seal land 38.

An annular pocket 60 in the abradable coating 56 or the starter seal land 38 reduces or eliminates contact between the starter tooth 32 and the abradable coating 56 or the starter seal land 38 when the aspirating face seal 16 is closed. Reducing or eliminating starter tooth contact prevents undesirable forces from acting on the slider 42 and minimizes thermal distortion, which reduces the probability of non-rotatable face surface 124 cracking due to an air bearing rub.

The pocket 60 extends radially outwardly from a cylindrical radially outer abradable surface 67 of the starter seal land 38 or the abradable coating 56 to a pocket bottom 62. The pocket 60 includes axially spaced apart annular forward and aft sides 52, 54 extending radially inwardly from the pocket bottom 62. Thus, the pocket 60 is axially bounded by the forward and aft sides 52, 54 and radially inwardly bounded by the pocket bottom 62. The pocket bottom 62 may be a thin abradable material layer 63 of the starter seal land 38 or the abradable coating 56 surrounding the radially inwardly facing cylindrical groove surface 59 along the non-rotatable member 102, as illustrated in FIG. 2. The embodiment of the pocket 60 illustrated in FIGS. 2-5 extends axially aftwardly from the annular forward groove side surface 64 into the starter seal land 38 or the abradable coating 56. The pocket 60 extends substantially along the axial portion 61 of the radially inwardly facing cylindrical groove surface 59 along the annular aft extension 51 of the slider 42 of the non-rotatable member 102.

Figure 15:
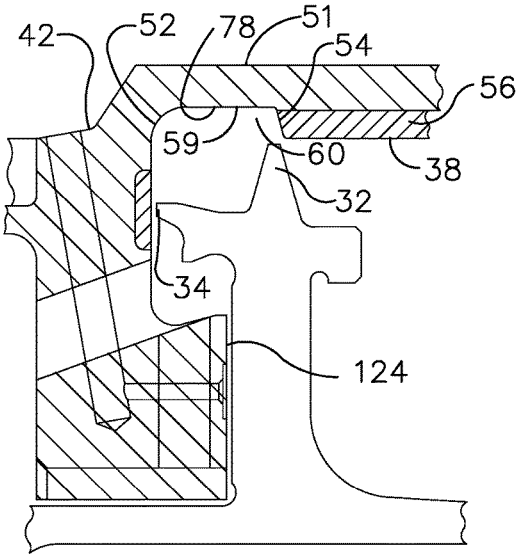
FIG. 15 is a diagrammatical illustration of a second alternative embodiment of the pocket illustrated in FIG. 2.

Alternatively, the pocket 60 may extend radially outwardly to the pocket bottom 62 which may be a portion 78 of the radially inwardly facing cylindrical groove surface 59, as illustrated in FIG. 15. The pocket bottom 62 illustrated in FIG. 15 is on the metallic radially inner facing surface 59 along the annular aft extension 51 of the slider 42 of non-rotatable member 102.

The primary seal land 40, in the embodiment of the aspirating face seal 16 illustrated in FIGS. 4 and 5, includes faces axially aftwardly from and is carried on the central ring 45 of the annular slider 42. The starter seal land 38 is located forward of the non-rotatable face surface 124 on the central ring 45. The non-rotatable face surface 124 is mounted on the central ring 45. The deflector tooth 36 extends axially forward and slightly radially inwardly from the forward carrier extension 35 of the seal teeth carrier 30. The forward carrier extension 35 extends forwardly from the seal teeth carrier 30 and supports the primary and the deflector teeth 34, 36. The starter tooth 32 extends substantially radially from the seal teeth carrier 30 and substantially normal to the centerline axis 8 of the engine 10. The primary and starter seal lands 40, 38 may be made of or include an abradable material. The abradable material may be a honeycomb material, thermal spray abradable material such as nickel graphite, or other abradable material.

The non-rotatable face surface 124 is located radially inwardly of the primary and starter seal lands 40, 38 on the annular slider 42 and is substantially parallel to the rotatable face surface 125 on the rotatable member 104. The non-rotatable and rotatable face surfaces 124, 125 are axially spaced apart a variable distance 123. Under a pressure differential between the high and low pressure regions 48, 46, the slider 42 moves axially aft, closing the non-rotatable and rotatable face surfaces 124, 125. A variable axial length annular plenum 69 extends axially between the slider 42 and the rotatable face surface 125. A gas bearing space 100 extends axially between the non-rotatable and rotatable face surfaces 124, 125.

Referring to FIGS. 3-5, air feed passages 110 extend through the central ring 45 of the annular slider 42 and from the high pressure region 48 to the gas bearing space 100 between the non-rotatable and rotatable face surfaces 124, 125. The exemplary embodiment of the air feed passages 110 illustrated herein includes feed holes 112 extending generally radially inwardly from the high pressure region 48 through the central ring 45 to corresponding axially extending orifice bores 114 in the central ring 45. The orifice bores 114 extend axially through the central ring 45 from the feed holes 112 through the non-rotatable face surface 124 to the gas bearing space 100.

First and second pluralities 93, 95 of circumferentially spaced apart first and second vent passages 96, 98 through the central ring 45 of the annular slider 42 provide pressure communication between the plenum 69 and low pressure region 46 as illustrated in FIG. 4. The first and second vent passages 96, 98 vent the plenum 69 to the low pressure region 46 during engine operation when there is a substantial pressure differential between high and low pressure regions 48, 46. The first vent passages 96 are inclined radially inwardly and extend from the plenum 69 forward and radially inwardly. The second vent passages 98 extend substantially radially inwardly from the plenum 69 through the central ring 45 of the annular slider 42.

The starter tooth 32 is used to initiate closure of the aspirating face seal 16. The starter tooth 32 is located on the seal teeth carrier 30 mounted on the rotatable member 104 and extends radially towards the non-rotatable abradable starter seal land 38. This design allows the starter tooth to rub into an abradable during high radial excursions rather than have metal to metal contact. The deflector tooth 36 is used to help reduce build-up of interior pressures in the gas bearing space 100 and the annular plenum 69 between the stationary and rotating seal surfaces.

Figure 5A:
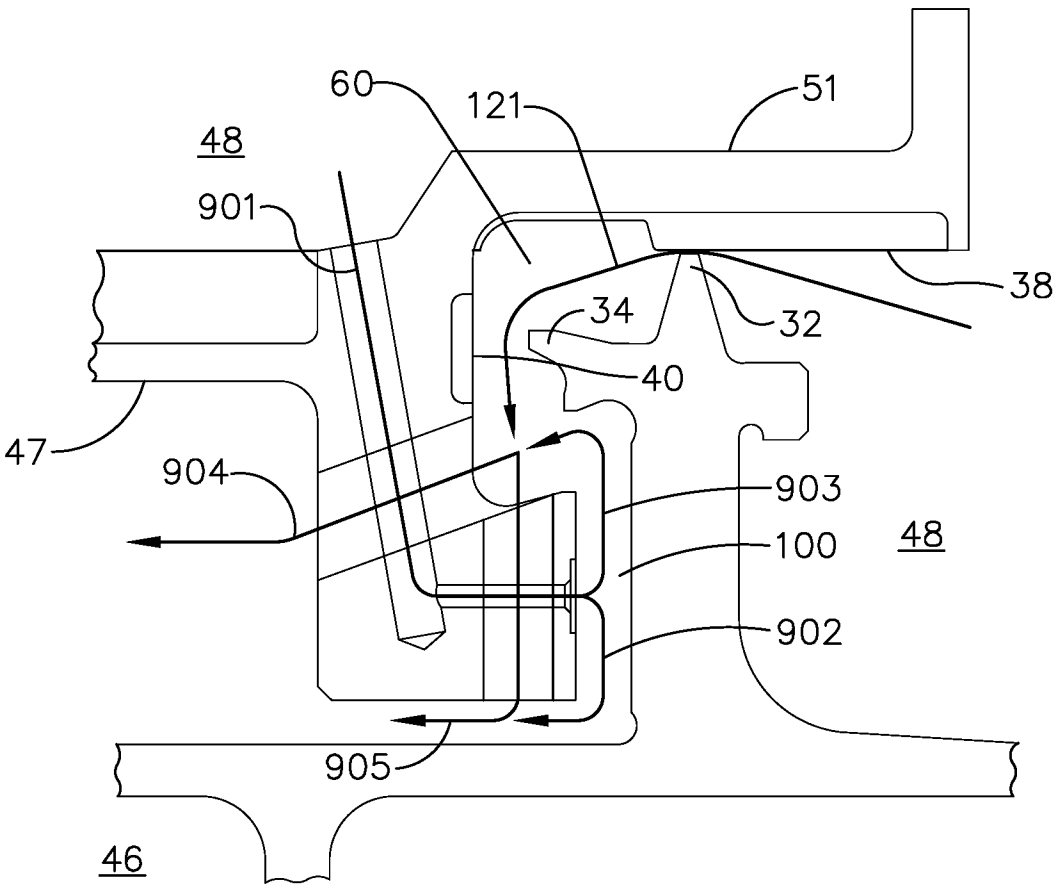
FIG. 5A is a diagrammatical illustration of air flows through the aspirating gas bearing face seal illustrated in FIG. 4.
Figure 6:
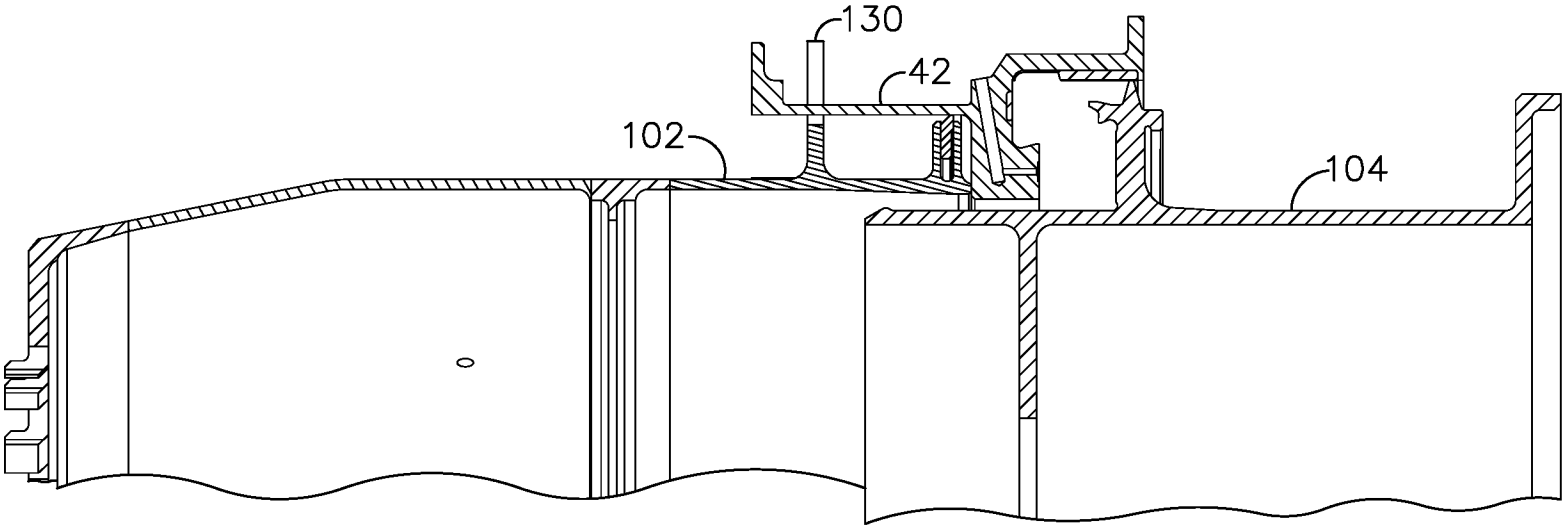
FIG. 6 is a cross-sectional view illustration of a slider and the aspirating gas bearing face seal illustrated in FIG. 4.
Figure 7:
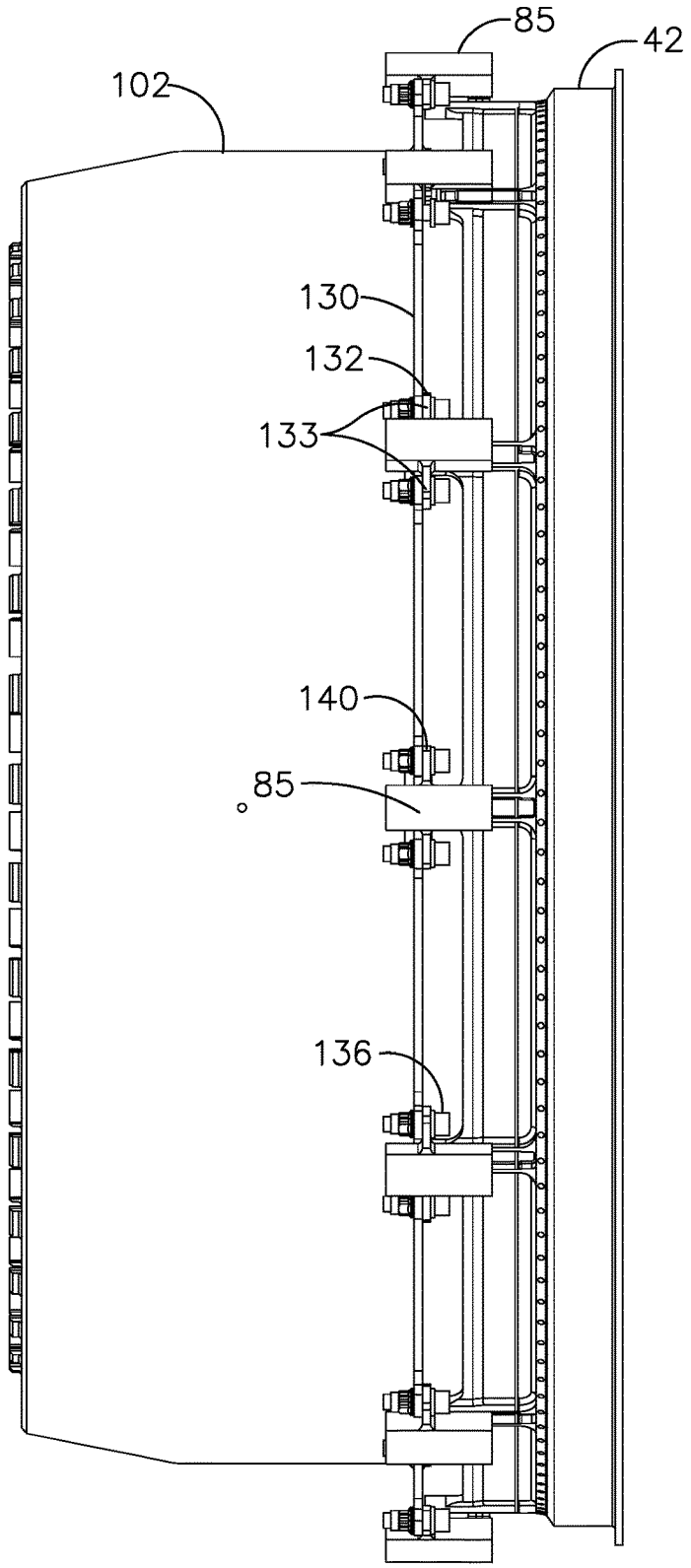
FIG. 7 is a radially inwardly looking perspective view illustration of the slider illustrated in FIG. 6.
Figure 8:
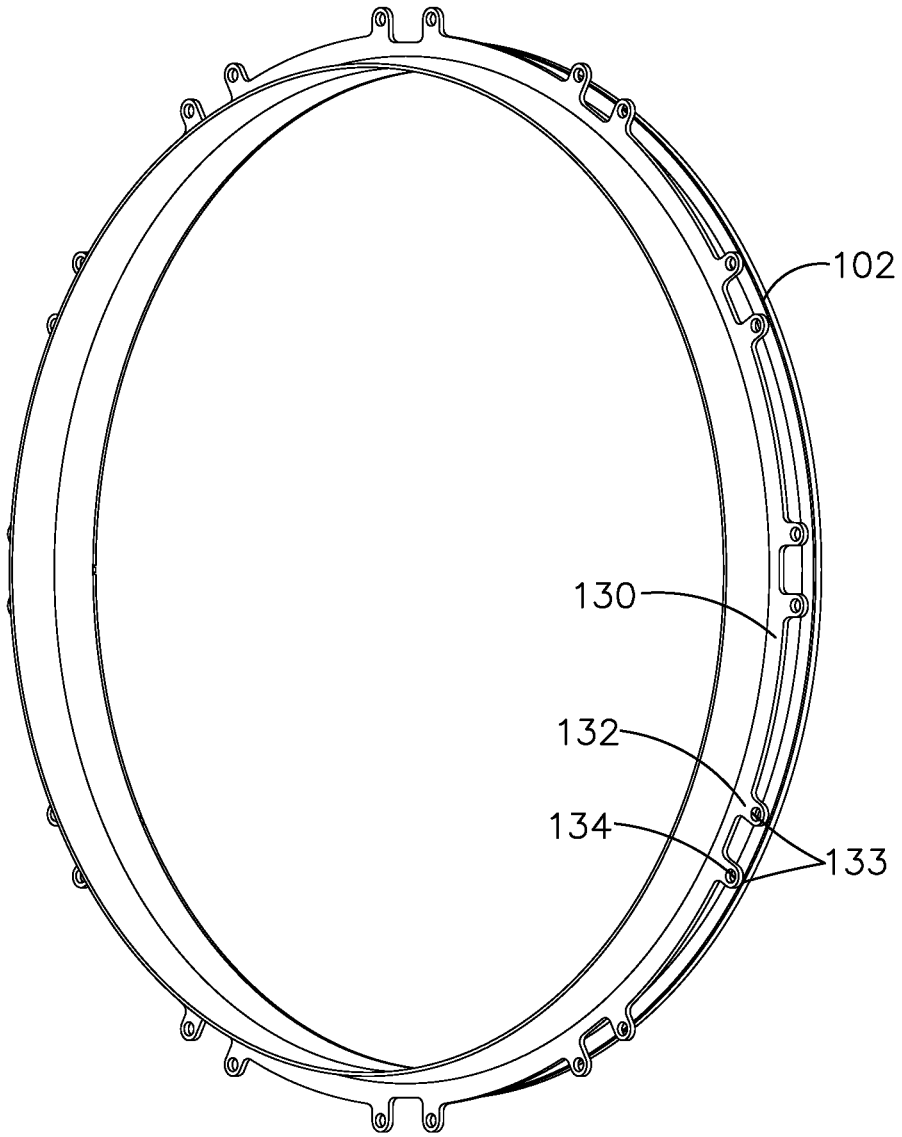
FIG. 8 is perspective view illustration of an annular flange around and fixed to the stator illustrated in FIG. 3.
Figure 21:
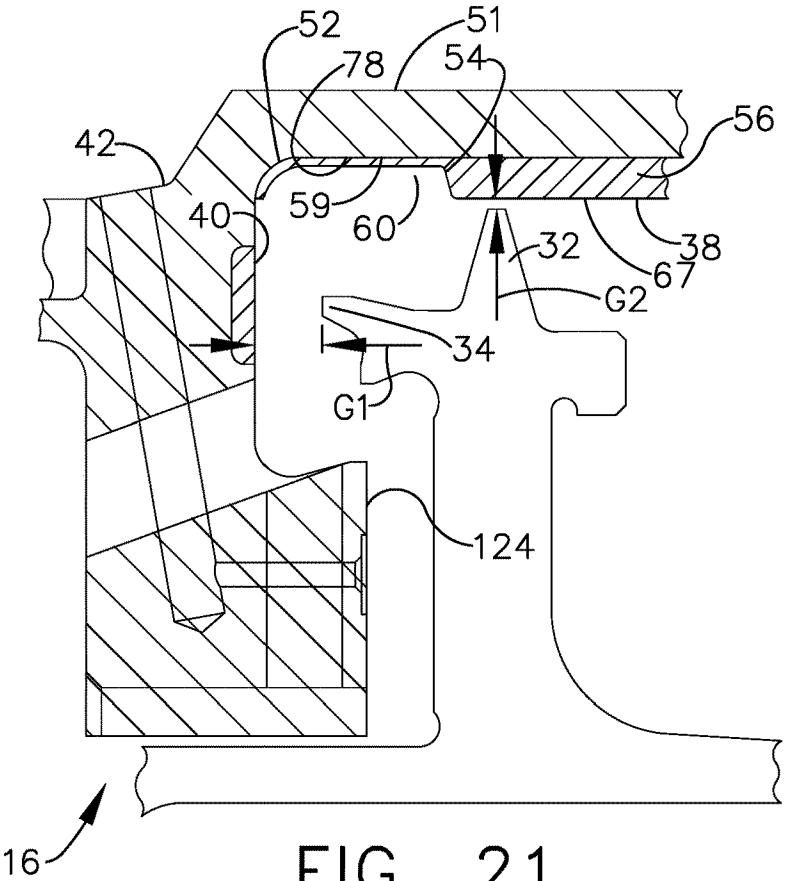
FIG. 21 is a cross-sectional view illustration of the aspirating gas bearing face seal illustrated in FIG. 2 in an open position with a starter tooth directly below the starter tooth land.

FIGS. 5A and 21 illustrates various air flows and tooth gaps for the aspirating face seal 16 during engine operation when the aspirating face seal 16 is partially open. Primary tooth and starter tooth gaps G1, G2 between the primary and starter teeth 34, 32 and the primary and starter seal lands 40, 38 respectively allow room to draw flow between the teeth and lands. Bearing flow 901 comes from the high pressure region 48 through the air feed passages 110 into the gas bearing space 100 between the non-rotatable and rotatable face surfaces 124, 125. The bearing flow 901 exits the gas bearing space 100 as radially outward bearing flow 903 and radially inward bearing flow 902. The radially outward bearing flow 903 passes through the first and second vent passages 96, 98 and together with the radially inward bearing flow 902 passes through a gap between the rotatable member 104 and the non-rotatable member 102 to reach the low pressure region 46.

Seal flow 121 leaks or flows between the starter seal tooth 32 and the starter seal land 38 and then between the primary seal tooth 34 and the primary seal land 40. During engine operating conditions with the aspirating face seal 16 closed, the primary tooth 34 is the main restriction to air flow through the aspirating face seal 16. The seal flow 121 merges with the radially outward bearing flow 903 in the annular plenum 69, and the merged flows exit the aspirating face seal 16 as vent flow 904 passing through the first and second vent passages 96, 98 respectively. The merged flows then pass through the gap between the rotatable member 104 and the non-rotatable member 102 to reach the low pressure region 46.

The primary seal flow 121 across the primary tooth 34 and radially outward bearing flow 903 enter the plenum 69 as jets, due to a pressure drop across the aspirating face seal 16 from the high pressure region 48 to the low pressure region 46. The primary seal flow 121 exits the primary tooth gap G1 between the primary tooth 34 and the primary seal land 40 traveling substantially radially inward towards the first and second vent passages 96, 98. The radially outward bearing flow 903 enters the plenum 69 traveling radially outwardly and is redirected by deflector tooth 36 towards the first and second vent passages 96, 98. The radially outward bearing flow 903 and the primary seal flow 121 merge into the axial and radially inward vent flows 904, 905 which flow out from plenum 69 through the first and second vent passages 96, 98 respectively to the low pressure region 46.

The redirection of radially outward bearing flow 903 by the deflector tooth 36 increases flow into the vent passages 96 causing a higher discharge coefficient (Cd) and greater effective passage area. This causes the air pressure in plenum 69 to approach that of the low pressure region 46. Similarity in pressure between plenum 69 and the low pressure region creates a more stable force balance acting on the slider 42, which results in a more determinate operating clearance between air bearing surfaces. Cd is a standard engineering ratio used to find the effective area of a hole or passage that a fluid is passing through, i.e actual area*Cd=effective area. A perfect Cd=1, but Cd for real holes is lower.

Figure 12:
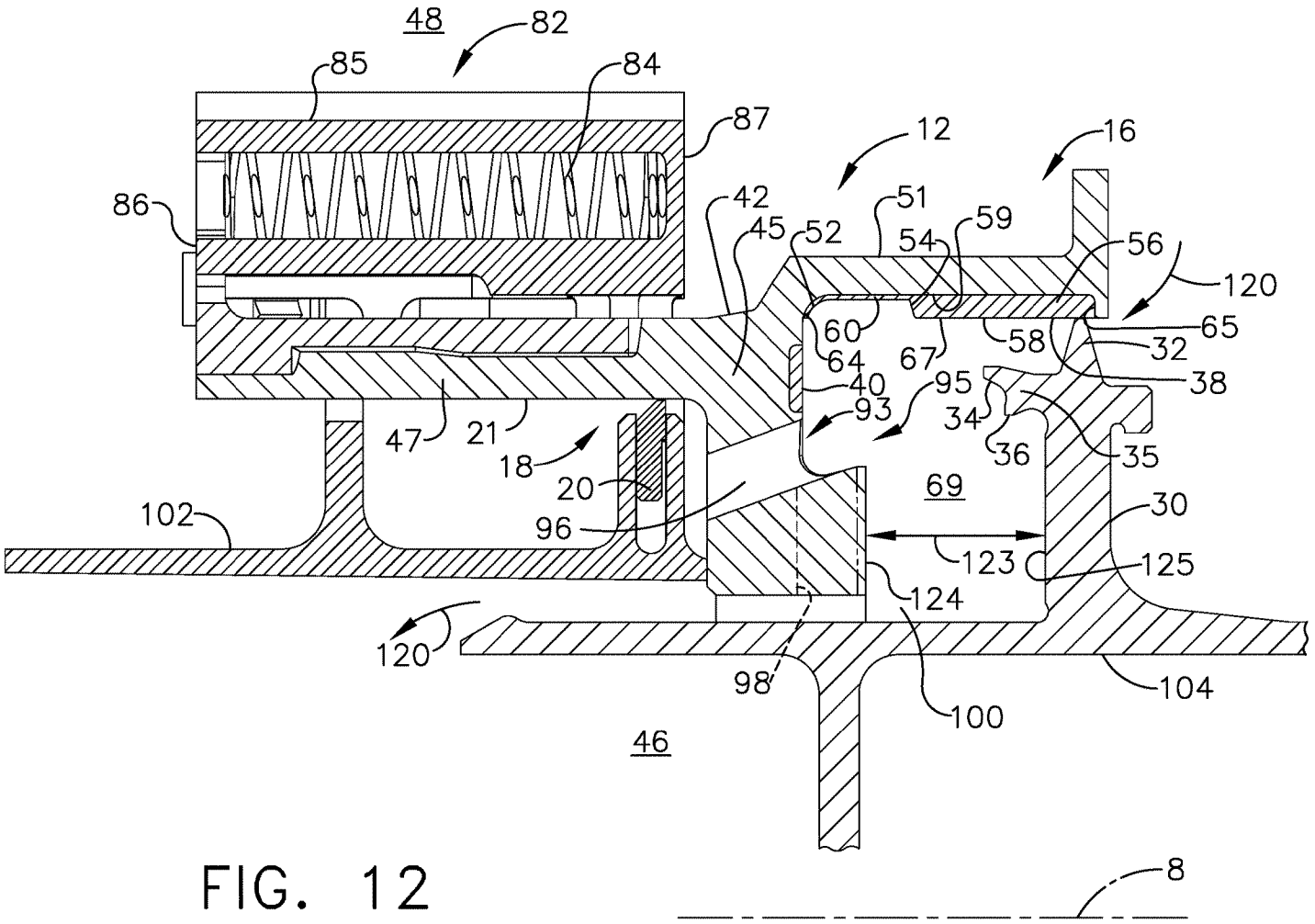
FIG. 12 is a cross-sectional view illustration of an alternative embodiment of the aspirating gas bearing face seal illustrated in FIG. 2 with an oil dam on the stator.

During higher power operation, the primary tooth 34 restricts the AFS air flow 120 flowing from the relatively high pressure region 48 to the relatively low pressure region 46, thereby, causing an increase in the pressure differential between high and low pressure regions 48, 46. A high pressure differential between high and low pressure regions 48, 46 acts on areas of the slider 42 upstream of the starter tooth 32 resulting in a net axial force that pushes the slider 42 and the primary and starter seal lands 40, 38 located on the slider 42 toward the rotatable face surface 125 on the rotatable member 104 and the primary, starter, and deflector teeth 34, 32, 36. The aspirating face seal 16 is illustrated in an open position in FIG. 12 and in a closed position in FIG. 4.

Illustrated in FIGS. 1-4 is a retracting means 82 for retracting the annular slider 42 and the non-rotatable face surface 124 away from the rotatable member 104 and the rotatable surface 125 during low or no power conditions. This causes the gas bearing space 100 and the annular plenum 69 to axially lengthen and the primary seal land 40 on the slider 42 to retract from the primary tooth 34.

Figure 9:
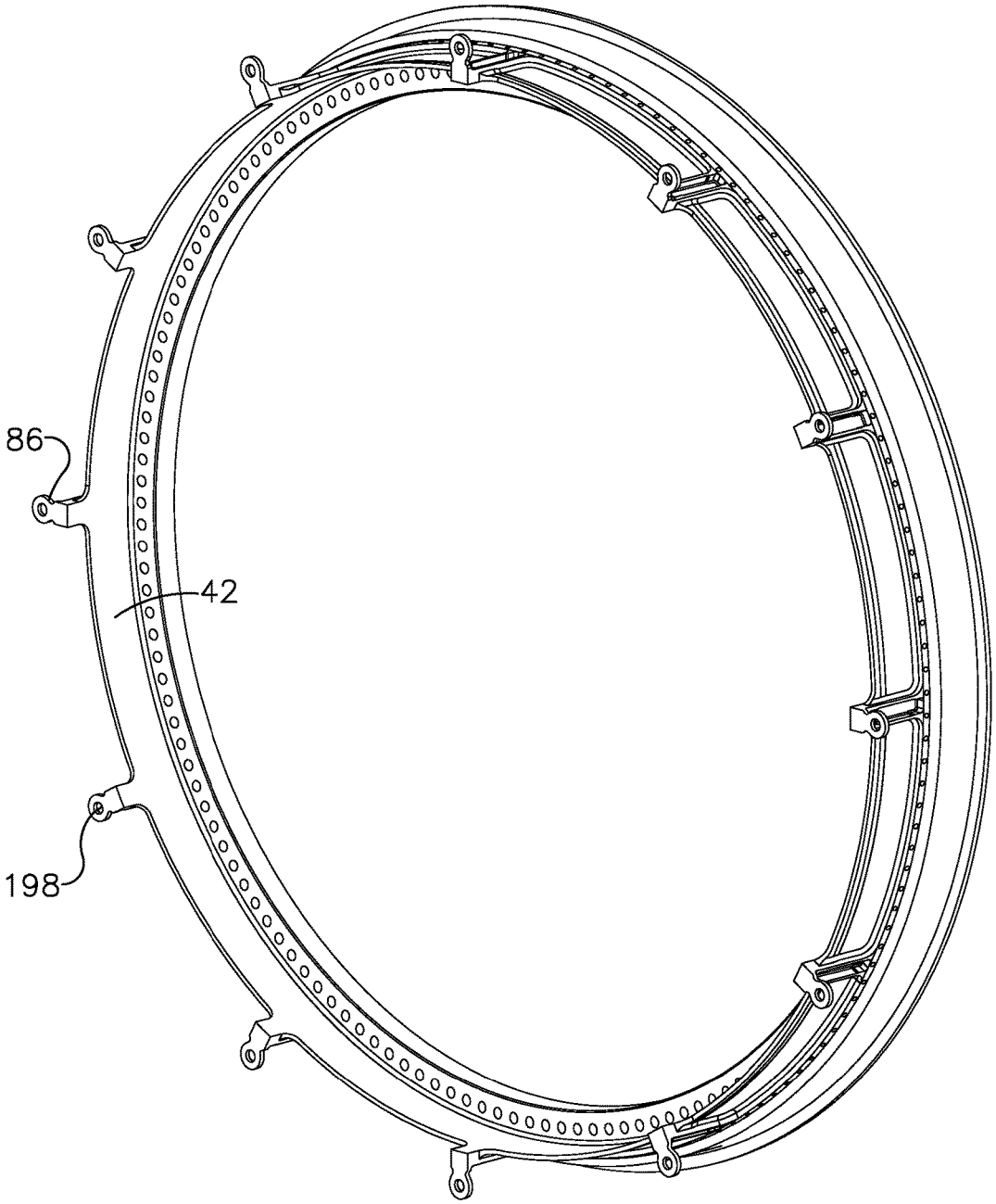
FIG. 9 is perspective view illustration of the slider illustrated in FIG. 3.
Figure 10:
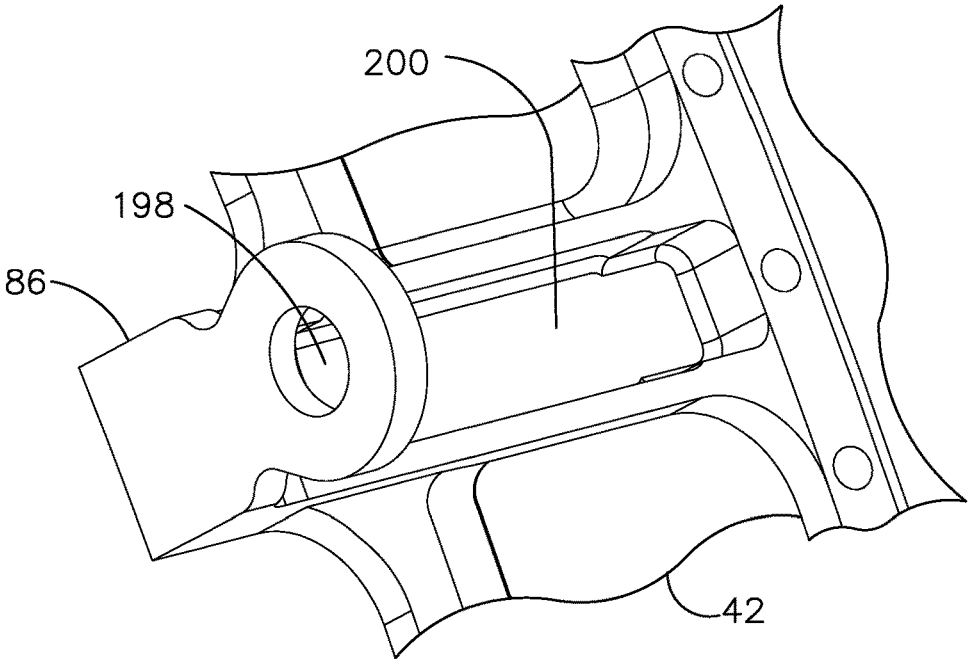
FIG. 10 is perspective view illustration of a groove in the slider for receiving a tongue extending inwardly from a housing of a spring cartridge illustrated in FIG. 3.
Figure 11:
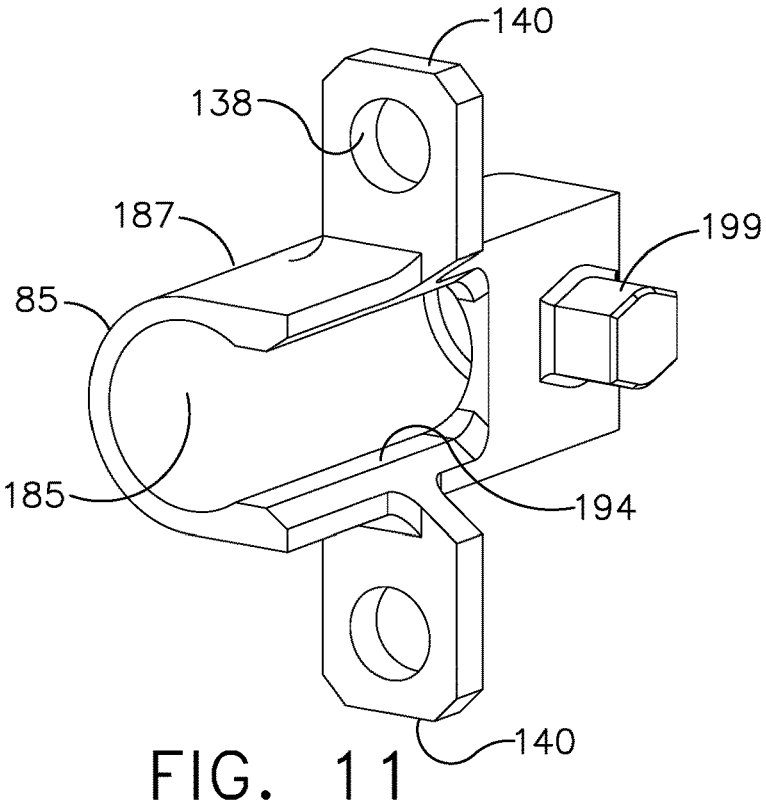
FIG. 11 is perspective view illustration of the housing of the spring cartridge mounted to the flange illustrated in FIG. 3.

Referring to FIGS. 2-4, the exemplary embodiment of the retracting means 82 includes a plurality of circumferentially spaced apart coil springs 84 disposed within spring chambers 185 of circumferentially spaced apart cartridges 85. Each of the cartridges 85 includes an annular housing 187 surrounding the spring chamber 185 attached to the annular non-rotatable member 102. An aft end wall 87 of the annular housing 187 may be attached to the annular non-rotatable member 102. A forward end 190 of the coil spring 84 rests against an axially forward static stop finger 86 which extends radially outwardly from and is attached to or part of the axially translatable annular slider 42 as further illustrated in FIG. 9. The stop finger 86 may be integrally formed with the axially translatable annular slider 42 as illustrated herein. A plug 192 disposed in an aperture 198 in the stop finger 86 extends into the chamber and anchors the coil spring 84 as illustrated in FIGS. 3-4.

The stop finger 86 extends radially through an axially extending slot 194 in the annular housing 187 into the spring chamber 185 as illustrated in FIGS. 3-4. This allows the slider 42 to translate axially and allows the coil spring 84 to compress and expand, thus, biasing the slider 42. A tongue 199 extends radially inwardly from the housing 187 into a groove 200 in the slider 42. This tongue and groove arrangement helps guide the axially translatable slider 42 during axial translation relative to the static housing 187 of the static cartridge 85. The slider 42 is thus capable of axial translation and limited gimballing motion in response to an axial force and tilt moments respectively.

Referring to FIGS. 2-4 and 6-11, the cartridge 85 is connected or attached to the annular non-rotatable member 102. The exemplary embodiment of the seal illustrated herein includes an annular flange 130 around and fixed to the annular non-rotatable member 102. The cartridges 85 are attached to the annular flange 130. The cartridges 85 may be attached to the annular flange 130 using pairs 133 of lugs 132 extending radially outwardly from the annular flange 130. The cartridges 85 may be bolted to the lugs 132 with bolts 136 disposed through ear bolt holes 138 through ears 140 attached to the cartridges 85 and through lug bolt holes 134 disposed through the lugs 132. Thus, the cartridges 85 may be removably mounted to the annular non-rotatable member 102. The annular flange 130 is illustrated herein as being continuous but may be segmented.

The retracting means 82 and the coil springs 84 are upstream, with respect to the bearing airflow in the gas bearing space 100, of the annular slider 42 and aspirating face seal 16 in the high pressure region 48. The retracting means 82 and the springs 84 are positioned upstream from the secondary seal 18 with respect to bearing airflow through the aspirating face seal 16. The retracting means 82, including the coil springs 84 are positioned radially outwardly of the forward extension 47, and the secondary seal 18 is positioned radially inwardly of the forward extension 47. The secondary seal 18 is in sealing engagement with an annular radially inner slider surface 21 of the annular slider 42 and is located on a border between the high and low pressure regions 48, 46. The retracting means 82 and the coil springs 84 are located radially outwardly of the annular slider 42 and the secondary seal 18 is located radially inwardly of the annular slider 42. The arrangement of the retracting means 82 and the secondary seal 18 reduces deflection of the non-rotatable face surface 124 on the annular slider 42.

The central ring 45 of the annular slider 42 is designed to translate between axial retracted and sealing positions RP, SP as illustrated in FIGS. 2 and 4, respectively, as a result of forces, illustrated in FIG. 5, acting on the central ring 45. The forces are the result of pressures in the relatively low and high pressure regions 46, 48 acting on surfaces and spring forces of the retracting means 82.

Referring to FIG. 2, as the engine is started, the pressure in the high pressure region 48 begins to rise because the starter tooth 32 restricts the AFS air flow 120 flowing from the relatively high pressure region 48 to the relatively low pressure region 46. The pressure differential between the low and high pressure regions 46, 48 results in a closing pressure force acting on central ring 45. The pressure force acts against a spring force from the retracting means 82 to push the central ring 45 and non-rotatable face surface 124 mounted thereupon towards the gas bearing rotatable face surface 125. FIG. 5 illustrates high and low pressure closing forces acting on the aspirating face seal 16 during engine start-up and how the closing forces overcomes the spring force. Referring to FIG. 4, during shutdown of the engine, pressure in the high pressure region 48 drops off and the springs 84 of the retracting means 82 overcome the closing force and retract the aspirating face seal 16. Opening forces from high pressure air in the air bearing between the rotatable and non-rotatable face surfaces 125, 124 are also illustrated in FIG. 5.

Figure 13:
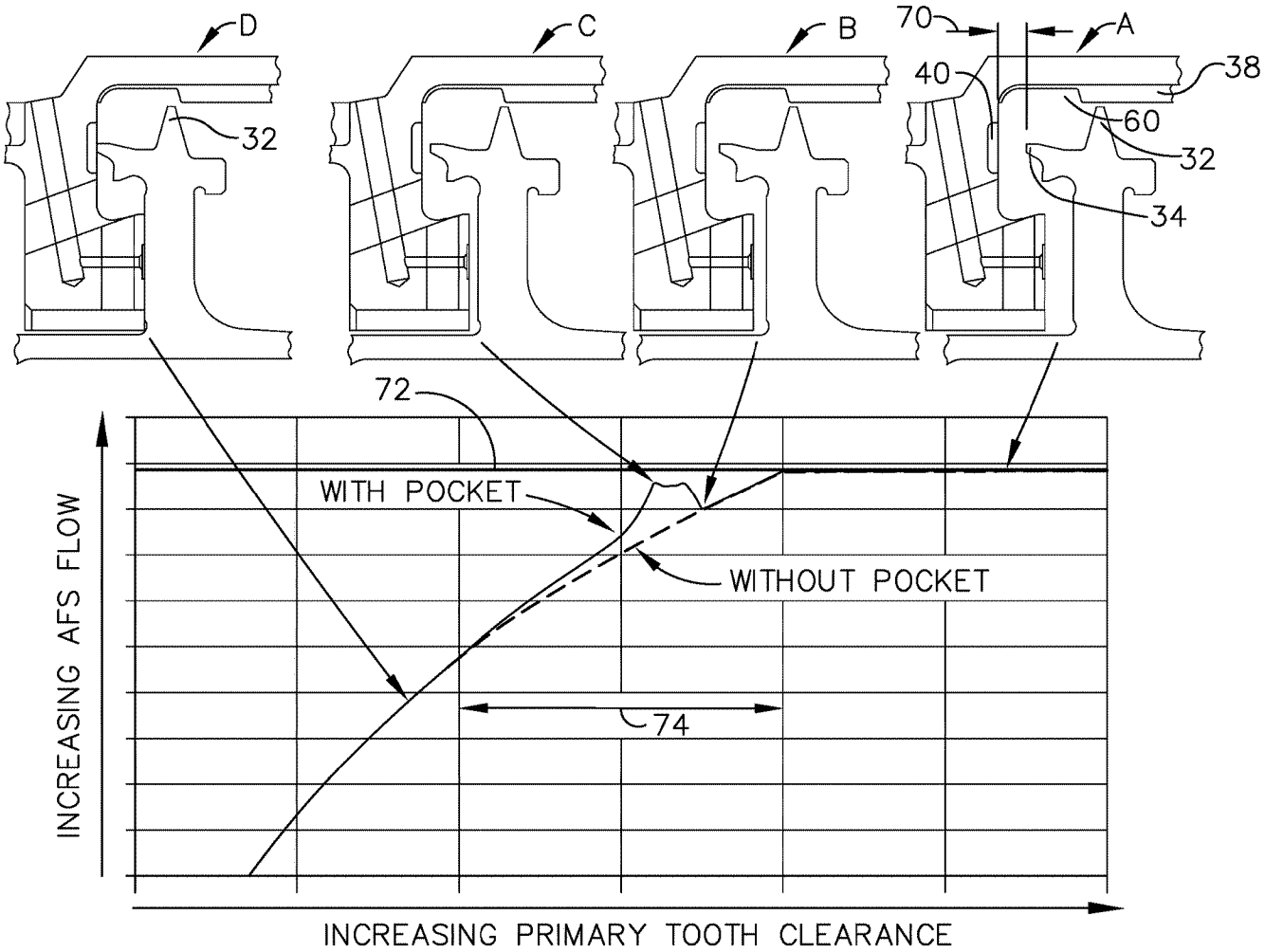
FIG. 13 is an exemplary graphical and diagrammatical cross-sectional view illustration of flow through the aspirating gas bearing face seal illustrated in FIG. 2.

FIG. 13 graphically illustrates modeling of total airflow through the aspirating face seal 16, the high pressure AFS air flow 120, for aspirating face seals with and without the annular pocket 60 in the abradable coating 56. The solid line represents total airflow through the aspirating face seal 16 with the annular pocket 60. The dashed line represents total airflow through the aspirating face seal 16 without the annular pocket 60. Results of the simulation indicate that for large primary tooth clearances 70, configuration A, the starter tooth 32 is the metering feature and the AFS flow remains within acceptable limits 72.

As the primary tooth clearance 70 gets smaller, configuration B, (in the model), the metering feature transitions from the starter tooth 32 to the primary tooth 34. In a transition region 74 between configurations B and C, the AFS flow 120 for the abradable coating 56 with the pocket 60 increases slightly compared to the seal without the pocket 60. For primary tooth clearances 70 which are small, configuration D, the AFS flow is the same for both the abradable coating 56 with and without the pocket 60.

The starter tooth abradable pocket 60 is sized to ensure the AFS flow 120 does not exceed an acceptable limit 72 as the seal metering feature transitions from the starter tooth 32 to the primary tooth 34. As a result, there is no impact to the sealing function. In addition, the pocket 60 is sized to reduce or eliminate starter tooth rubs in a transition region and closed position. Reducing or eliminating starter tooth rubs minimizes undesirable slider forces and thermal distortion, which minimizes the air bearing deflection and reduces the risk of an air bearing rub.

Figure 14:
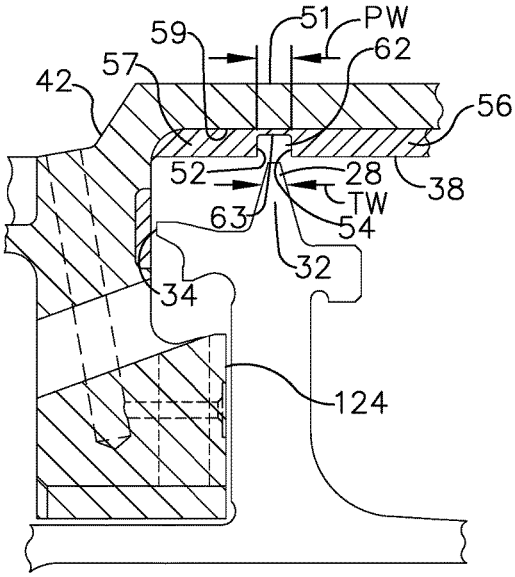
FIG. 14 is a diagrammatical illustration of a first alternative embodiment of the pocket illustrated in FIG. 2.
Figure 16:
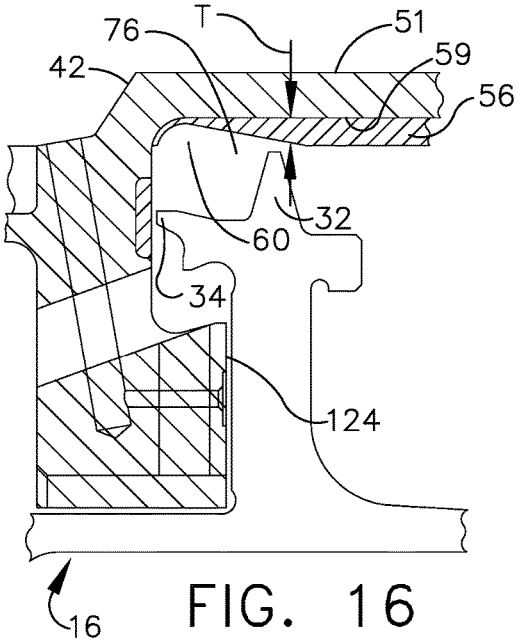
FIG. 16 is a diagrammatical illustration of a third alternative embodiment of the pocket illustrated in FIG. 2.

FIGS. 14-16 illustrate alternative configurations of the annular pocket 60 and the abradable coating 56. Illustrated in FIG. 14 is a first alternate configuration with a U-shaped pocket 60 which may simplify manufacturing and be less expensive. The U-shaped pocket 60 is bounded axially by the abradable material 57 of the abradable coating 56 or the starter seal land 38. The pocket bottom 62 may include a thin abradable material layer 63 of the abradable material 57 of the starter seal land 38 or the abradable coating 56 surrounding the radially inwardly facing cylindrical groove surface 59 along the non-rotatable member 102. A pocket width PW of the pocket 60 between the axially spaced apart annular forward and aft sides 52, 54 is greater than a tip width TW of a radially outer tip 28 of the starter tooth 32.

Illustrated in FIG. 15 is a second alternate configuration having the coating 56 above the starter tooth 32 completely removed. Coating in this region is not necessarily required. The pocket 60 extends radially outwardly to the metallic radially inner facing surface 59 of the annular aft extension 51 of the slider 42.

Illustrated in FIG. 16 is a third alternate pocket 60 with a tapered pocket 60 in the coating 56. A taper 76 of the pocket 60 decreases and a thickness T of the coating 56 in the pocket 60 increases aftwardly away from the non-rotatable face surface 124 on the annular slider 42. The taper 76 of the pocket 60 decreases and the thickness T of the coating 56 in the pocket 60 increases aftwardly away from the annular forward groove side surface 64. The taper may not completely eliminate a starter tooth rub, but it reduces the severity.

Figure 18:
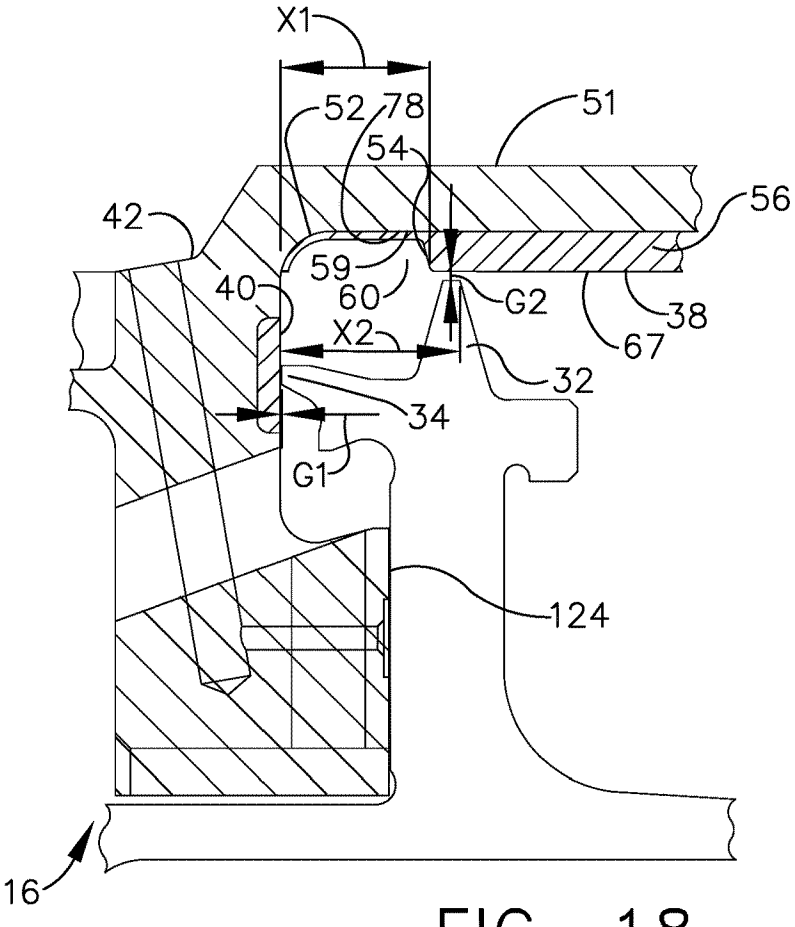
FIG. 18 is a cross-sectional view illustration of one embodiment of the aspirating gas bearing face seal illustrated in FIG. 2 in a closed position and the pocket sized too small.

Referring to FIG. 18, if the annular pocket 60 is too small, it will not prevent the starter tooth 32 from rubbing when the aspirating face seal 16 is closed. In this case, a first axial distance X1 from the primary seal land 40 to a pocket aft end of the pocket 60, is significantly smaller than a second axial distance X2 from the primary seal land 40 to the starter tooth 32.

Figure 19:
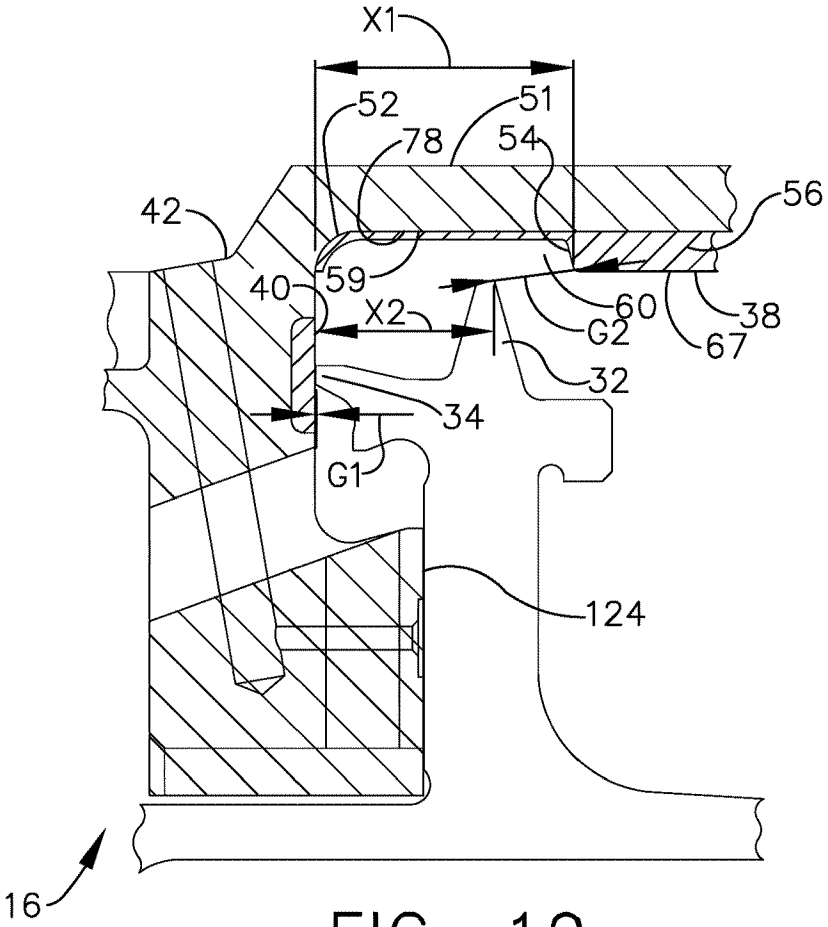
FIG. 19 is a cross-sectional view illustration of another embodiment of the aspirating gas bearing face seal illustrated in FIG. 2 in a closed position and the pocket sized too large.

FIG. 19 illustrates a pocket 60 which is too big and allows a starter tooth gap G2 to get large before the primary tooth 34, which controls the primary tooth gap G1, takes over as the flow metering feature. In this case, the first axial distance X1 from the primary seal land 40 to the pocket aft end is significantly larger than the second axial distance X2 from the primary seal land 40 to the starter tooth 32. A transition in which the starter tooth gap G2 does not get significantly large before the primary tooth gap G1 gets small is important for minimizing flow through the aspirating face seal 16.

Figure 20:
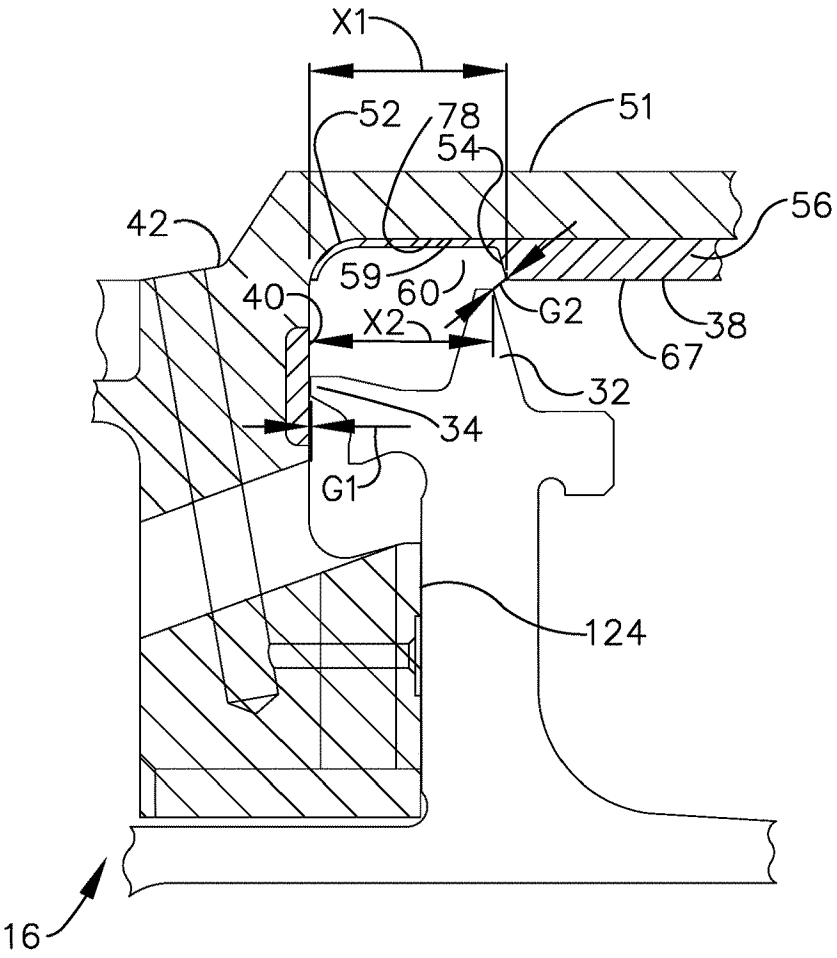
FIG. 20 is a cross-sectional view illustration of the aspirating gas bearing face seal illustrated in FIG. 2 in a closed position and the pocket desirably sized.

FIG. 20 illustrates a desirably sized embodiment of the pocket 60. It is big enough to prevent starter tooth rubs when the aspirating face seal 16 is closed and small enough to prevent excess leakage during the starter tooth 32 to the primary tooth 34 transition phase. In this case, the first axial distance X1 from the primary seal land 40 to the pocket aft end of the pocket 60 is slightly larger than the second axial distance X2 from the primary seal land 40 to the starter tooth 32. In one exemplary engine AFS design, the first and second axial distances X1, X2 are 0.395 inches and 0.360 inches, respectively. The 0.035 inch difference could vary for other applications but, in general, it is a good starting point for sizing the first and second axial distances X1, X2 of the pocket 60.

Figure 17:
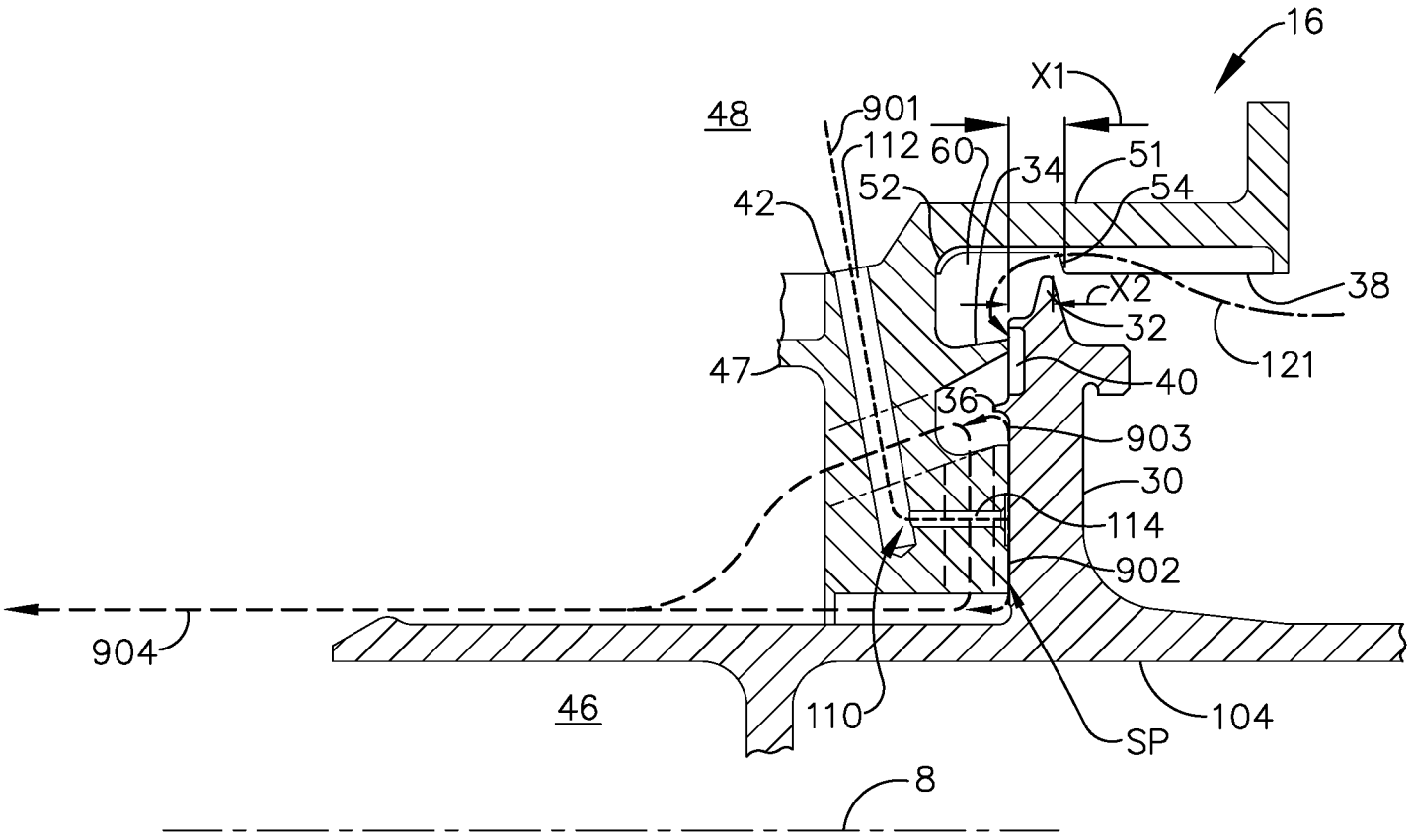
FIG. 17 is a cross-sectional view illustration of an alternative aspirating gas bearing face seal with a primary tooth mounted on an annular slider and starter and deflector teeth mounted on a rotatable member of the aspirating gas bearing.

An alternative embodiment of the aspirating face seal 16, illustrated in FIG. 17, includes a rotatable seal teeth carrier 30 in the form of a flange on the rotatable member 104. The rotatable face surface 125 is on the carrier 30. The primary tooth 34 is mounted on an annular slider 42 instead of the rotatable seal teeth carrier 30 on the rotatable member 104 as the embodiment illustrated in FIGS. 1-4. The starter and deflector teeth 32, 36 are mounted radially outwardly of the rotatable face surface 125 on the seal teeth carrier 30.

The primary and starter teeth 34, 32 are annular labyrinth seal teeth designed and operable to engage corresponding abradable primary and starter seal lands 40, 38. The primary seal land 40 faces axially forwardly from and is mounted on the teeth carrier 30. The primary seal land 40 located radially outwardly of the rotatable face surface 125 and the deflector tooth 36. The primary tooth 34 extends axially aftwardly from the annular slider 42 radially between the aft extension 51 and the central ring 45 of the annular slider 42. The deflector tooth 36 extends axially aftwardly from the seal teeth carrier 30. The starter tooth 32 extends substantially radially from the teeth carrier 30 and substantially normal to the centerline axis 8 of the engine 10.

FIG. 21 illustrates the starter tooth gap G2 between the starter tooth 32 and the abradable starter seal land 38 when the aspirating face seal 16 is partially open. The starter tooth gap G2 is measured as the minimum distance between the starter seal tooth 32 and the abradable starter seal land 38.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed:

1. A turbomachine aspirating face seal assembly comprising:

an aspirating face seal circumscribed about a centerline axis and operable for restricting leakage of high pressure air flow from a relatively high pressure region of the turbomachine to a relatively low pressure region of the engine at a juncture between a non-rotatable member of the turbomachine and a rotatable member of the turbomachine, the rotatable and non-rotatable members include gas bearing rotatable and non-rotatable face surfaces respectively, a starter tooth mounted on the rotatable member designed and operable to sealingly engage a corresponding abradable starter seal land on the non-rotatable member, and an annular pocket in an abradable coating or other abradable material of the abradable starter seal land.

2. The assembly as claimed in claim 1 further comprising the starter tooth being an annular labyrinth seal tooth.

3. The assembly as claimed in claim 1 further comprising a primary tooth and the starter and primary teeth being annular labyrinth seal teeth designed and operable to sealingly engage corresponding abradable starter and primary seal lands respectively on the non-rotatable member.

4. The assembly as claimed in claim 3 further comprising:

the abradable coating or the abradable material disposed in a radially inwardly facing groove extending radially outwardly into the non-rotatable member, the inwardly facing groove including a radially inwardly facing cylindrical groove surface along the non-rotatable member, and the radially inwardly facing groove including annular forward and aft groove side surfaces extending radially inwardly from the groove surface and axially bounding the abradable coating or the starter seal land.

5. The assembly as claimed in claim 4 further comprising the annular pocket extending radially outwardly from a cylindrical radially outer abradable surface of the starter seal land or the abradable coating to a pocket bottom and the pocket bottom including a thin abradable material layer of the abradable material of the starter seal land or the abradable coating surrounding the radially inwardly facing cylindrical groove surface along the non-rotatable member.

6. The assembly as claimed in claim 5 further comprising the annular pocket extending axially aftwardly from the annular forward groove side surface into the abradable coating or the starter seal land.

7. The assembly as claimed in claim 4 further comprising the annular pocket extending radially outwardly from a cylindrical radially outer abradable surface of the starter seal land or the abradable coating to a pocket bottom and the pocket bottom including a portion of the radially inwardly facing cylindrical groove surface.

8. The assembly as claimed in claim 7 further comprising the annular pocket extending axially aftwardly from the annular forward groove side surface into the abradable coating or the starter seal land.

9. The assembly as claimed in claim 4 further comprising the annular pocket extending radially outwardly from a cylindrical radially outer abradable surface of the starter seal land or the abradable coating to a pocket bottom and being bounded axially by the abradable material of the abradable coating or the starter seal land.

10. The assembly as claimed in claim 9 further comprising:

a pocket width between axially spaced apart annular forward and aft sides of the pocket, a tip width of a radially outer tip of the starter tooth, and the pocket width greater than the tip width.

11. The assembly as claimed in claim 9 further comprising the pocket bottom including a thin abradable material layer of the abradable material of the starter seal land or the abradable coating surrounding the radially inwardly facing cylindrical groove surface along the non-rotatable member.

12. The assembly as claimed in claim 4 further comprising:

the annular pocket being tapered, the annular pocket having a taper decreasing axially aftwardly away from the annular forward groove side surface, and a thickness of the coating in the annular pocket increasing axially aftwardly away from the annular forward groove side surface.

13. The assembly as claimed in claim 12 further comprising the tapered annular pocket extending axially aftwardly from the annular forward groove side surface into the starter seal land or the abradable coating.

14. The assembly as claimed in claim 2 further comprising:

an annular slider axially slidingly mounted on the non-rotatable member, the starter seal land and the non-rotatable face surface mounted on the slider, a retracting means for retracting the annular slider away from the rotatable member and the non-rotatable face surface away from the rotatable surface, a primary tooth, the starter and primary teeth being annular labyrinth teeth designed and operable to sealingly engage corresponding abradable starter and primary seal lands, the primary tooth on the rotatable member and the primary seal land on the slider or the primary tooth on the annular slider and the primary seal land on the rotatable member, the retracting means including a plurality of circumferentially spaced apart springs, and each of the springs axially disposed between the slider and the non-rotatable member.

15. The assembly as claimed in claim 14 further comprising:

the abradable coating or the abradable material disposed in a radially inwardly facing annular groove extending radially outwardly into the non-rotatable member, the inwardly facing annular groove including a radially inwardly facing cylindrical groove surface along the non-rotatable member, and the radially inwardly facing annular groove including annular forward and aft groove side surfaces extending radially inwardly from the groove surface and axially bounding the abradable coating or the starter seal land.

16. The assembly as claimed in claim 15 further comprising the annular pocket extending radially outwardly from a cylindrical radially outer abradable surface of the starter seal land or the abradable coating to a pocket bottom and the pocket bottom including a thin abradable material layer of the abradable material of the starter seal land or the abradable coating surrounding the radially inwardly facing cylindrical groove surface along the non-rotatable member.

17. The assembly as claimed in claim 16 further comprising the annular pocket extending axially aftwardly from the annular forward groove side surface into the abradable coating or the starter seal land.

18. The assembly as claimed in claim 15 further comprising the annular pocket extending radially outwardly from a cylindrical radially outer abradable surface of the starter seal land or the abradable coating to a pocket bottom and the pocket bottom including a portion of the radially inwardly facing cylindrical groove surface.

19. The assembly as claimed in claim 18 further comprising the annular pocket extending axially aftwardly from the annular forward groove side surface into the abradable coating or the starter seal land.

20. The assembly as claimed in claim 15 further comprising the annular pocket extending radially outwardly from a cylindrical radially outer abradable surface of the starter seal land or the abradable coating to a pocket bottom and being bounded axially by the abradable material of the abradable coating or the starter seal land.

21. The assembly as claimed in claim 20 further comprising:

a pocket width between axially spaced apart annular forward and aft sides of the pocket, a tip width of a radially outer tip of the starter tooth, and the pocket width greater than the tip width.

22. The assembly as claimed in claim 20 further comprising the pocket bottom including a thin abradable material layer of the abradable material of the starter seal land or the abradable coating surrounding the radially inwardly facing cylindrical groove surface along the non-rotatable member.

23. The assembly as claimed in claim 15 further comprising:

the annular pocket being tapered, the annular pocket having a taper decreasing axially aftwardly away from the annular forward groove side surface, and a thickness of the coating in the annular pocket increasing axially aftwardly away from the annular forward groove side surface.

24. The assembly as claimed in claim 23 further comprising the tapered annular pocket extending axially aftwardly from the annular forward groove side surface into the starter seal land or the abradable coating.

25. The seal assembly as claimed in claim 14 further comprising the starter tooth mounted on a seal teeth carrier on the rotatable member.

26. The seal assembly as claimed in claim 25 further comprising the seal teeth carrier including an annular flange on the rotatable member and the rotatable face surface on the carrier.

27. The assembly as claimed in claim 4 further comprising:

the annular pocket sized to reduce or eliminate starter tooth rubs during transition and closed position of the aspirating face seal, transition is where the primary tooth takes over from the starter tooth as a flow metering feature through the aspirating face seal during operation, and the annular pocket sized big enough to prevent starter seal tooth rubs and small enough to prevent excess leakage during the starter tooth to the primary tooth transition.

28. The assembly as claimed in claim 27 further comprising a first axial distance from the primary seal land to a pocket aft end of the pocket slightly larger than a second axial distance from the primary seal land to the starter tooth.

29. The assembly as claimed in claim 28 further comprising a difference of about 0.035 inches between the first and second axial distances.

30. The assembly as claimed in claim 14 further comprising:

the annular pocket sized to reduce or eliminate starter tooth rubs during transition and closed position of the aspirating face seal, transition is where the primary tooth takes over from the starter tooth as a flow metering feature through the aspirating face seal during operation, and the annular pocket sized big enough to prevent starter seal tooth rubs and small enough to prevent excess leakage during the starter tooth to the primary tooth transition.

31. The assembly as claimed in claim 30 further comprising a first axial distance from the primary seal land to a pocket aft end of the pocket slightly larger than a second axial distance from the primary seal land to the starter tooth.

32. The assembly as claimed in claim 31 further comprising a difference of about 0.035 inches between the first and second axial distances.

* * * * *